US006481088B1

(12) United States Patent
Inoue et al.

(10) Patent No.: US 6,481,088 B1
(45) **Date of Patent: *Nov. 19, 2002**

(54) GOLF CLUB MANUFACTURING METHOD

(75) Inventors: Akihisa Inoue, Kawauchijutaku 11-806, Kawauchi-Motohasekura 35-banchi, Aoba-ku, Sendai-shi, Miyagi (JP); Eiichi Makabe, Miyagi (JP); Masahide Onuki, Hyogo (JP)

(73) Assignees: Akihisa Inoue, Miyagi (JP); Kabushiki Kaisha Makabe Giken, Miyagi (JP); Sumitomo Rubber Industries, Ltd., Hyogo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/112,360

(22) Filed: Jul. 9, 1998

(30) Foreign Application Priority Data

Jul. 9, 1997 (JP) ..... 9-184115
Jun. 4, 1998 (JP) ..... 10-172171

(51) Int. Cl.[7] ..... B21B 1/46
(52) U.S. Cl. ..... 29/527.5; 164/80; 164/495; 473/324
(58) Field of Search ..... 29/527.5; 473/324, 473/349, 345, 350, 342, 329; 164/80, 495

(56) References Cited

U.S. PATENT DOCUMENTS 3,856,513 A * 12/1974 Chen et al.
4,252,262 A * 2/1981 Igarashi (List continued on next page.)

FOREIGN PATENT DOCUMENTS

JP 8-109419 4/1996

OTHER PUBLICATIONS

Tool and Manufacturing Engineers Handbook, 3d Ed., Society of Manufacturing Engineers p. 14–26, 1977.*

(List continued on next page.)

*Primary Examiner*—David P. Bryant
*Assistant Examiner*—Steven Blount
(74) *Attorney, Agent, or Firm*—Young & Thompson

(57) ABSTRACT

A golf club which has a clubface of desired shape comprising an alloy metal is provided. The golf club has excellent strength properties as well as excellent ball hitting properties. The clubface is free from casting defects such as cold shuts, and preferably, free from the crystalline phase formed from crystal nuclei through nonuniform nucleation since the club face is produced in a simple, highly reproducible, one-step process by selectively cooling the molten metal at a temperature above the melting point at a rate higher than the critical cooling rate, and the product comprises a single amorphous phase. The metallic glass face used in the golf club is produced by filling a metal material in a hearth; melting said metal material by using a high-energy heat source which is capable of melting said the metal material; pressing said the molten metal at a temperature above the melting point of said the metal material to deform the molten metal into the desired shape by at least one of compressive stress and shear stress at a temperature above the melting point, while avoiding the surfaces of the molten metal cooled to a temperature below the melting point of said the metal material from meeting with each other during the pressing; and cooling said the molten metal at a cooling rate higher than the critical cooling rate of the metal material simultaneously with or after said the deformation to produce the metallic glass face of desired form.

15 Claims, 10 Drawing Sheets

U.S. PATENT DOCUMENTS 4,298,382 A * 11/1981 Stempin et al.
4,455,177 A * 6/1984 Filippov et al.
4,754,975 A * 7/1988 Aizawa
4,802,844 A * 2/1989 Kuhn et al.
4,928,965 A 5/1990 Yamaguchi et al.
4,964,927 A * 10/1990 Smiflet et al.
4,965,139 A * 10/1990 Kabacoff et al.
5,213,148 A 5/1993 Masumoto et al.
5,266,027 A * 11/1993 Kuwayama
5,421,724 A * 6/1995 Facco
5,431,396 A * 7/1995 Shieh
5,564,994 A * 10/1996 Chang
5,711,363 A * 1/1998 Scruggs et al.
5,740,854 A 4/1998 Inoue et al.
5,896,642 A * 4/1999 Peker et al.
6,162,130 A * 12/2000 Masumoto
6,267,170 B1 * 7/2001 Onuki et al.
6,267,171 B1 * 7/2001 Onuki et al.

OTHER PUBLICATIONS

A. Inoue, "Stabilization of Supercooled Liquid and Opening–up of Bulk Glassy Alloys", pp. 19–24, Proc. Japan Acad., vol. 73, Ser. B, 1997.

PCT/JP98/02547, "Process and Apparatus for Producing Metallic Glass", filed Jun. 10, 1997, Application No. 9–168108.

* cited by examiner

GOLF CLUB MANUFACTURING METHOD

BACKGROUND OF THE INVENTION

This invention relates to a golf club which has a club head with a face comprising a metallic glass, namely, a so-called amorphous alloy face exhibiting excellent ball hitting properties. More specifically, this invention relates to a golf club which has a club head with a metallic glass face (amorphous alloy face) of desired shape exhibiting excellent strength properties owing to absence of the so-called cold shut which is the region that became amorphous alloy by meeting of the molten metal surfaces.

Various methods for producing amorphous alloys have been proposed. Exemplary such methods include the method wherein a molten metal or alloy in liquid state is solidified by quenching and the resulting quenched metal (alloy) powder is compacted at a temperature below the crystallization temperature to produce a solid of the predetermined configuration having the true density; and the method wherein a molten metal or alloy is solidified by quenching to directly produce an ingot of the amorphous alloy having the predetermined configuration. Almost all amorphous alloy produced by such conventional methods had an insufficiently small mass, and it has been impossible to produce a bulk material which can be used in golf club face by such conventional methods. Another attempt for producing a bulk material is solidification of the quenched powder. Such attempt, however, has so far failed to produce a satisfactory bulk material.

For example, the amorphous alloy produced in small mass have been produced by melt spinning, single roll method, planar flow casting and the like whereby the amorphous alloy in the form of thin strip (ribbon) in the size of, for example, about 200 mm in the strip width and about 30 $\mu$m in the strip thickness are produced. Use of such amorphous alloys for such purposes as the core material of a transformer has been attempted, but so far, most amorphous alloys produced by such methods are not yet put to industrial use. The techniques that have been used for solidification forming or compaction molding the quenched powder into an amorphous alloy of a small mass include CIP, HIP, hot press, hot extrusion, electro-discharge plasma sintering, and the like. Such techniques, however, suffered from the problems of poor flow properties due to the minute configuration, and the problem of temperature-dependent properties, namely, incapability of increasing the temperature above the glass transition temperature. In addition, forming process involves many steps, and the solidification formed materials produced suffer from insufficient properties as a bulk material. Especially, high strength, high toughness and other properties required for the face of a golf club can not be obtained. Therefore, such methods are still insufficient.

Recently, the inventors of the present invention found that a number of ternary amorphous alloys such as Ln—Al—TM, Mg—Ln—TM, Zr—Al—TM, Hf—Al—TM and Ti—Zr—TM (wherein Ln is a lanthanide metal, and TM is a transition metal of the Groups VI to VIII) ternary systems have low critical cooling rates for glass formation of the order of $10^2$ K/s, and can be produced in a bulk shape with thickness up to about 9 mm by using a mold casting or a high-pressure die casting method.

It has been, however, impossible to produce a large-sized amorphous alloy material of desired configuration irrespective of the production process. There is a strong need for the development of a new solidification technique capable of producing a large-sized amorphous alloy material and an amorphous alloy having a still lower critical cooling rate for enabling the production of the amorphous alloy of larger size.

In view of such situation, the inventors of the present invention proceeded with the investigation of the bulk amorphous alloy using the ternary alloy by focusing on the effect of increasing the number of the alloy constituents each having different specific atom size as exemplified by the high glass formation ability of the ternary alloy primarily attributable to the optimal specific size distribution of the constituent atoms that are mutually different in size by more than 10%. As a consequence, the inventors found amorphous alloys of Zr—Al—Co—Ni—Cu alloy systems, Zr—Ti—Al—Ni—Cu alloy systems, Zr—Ti—Nb—Al—Ni—Cu alloy systems, and Zr—Ti—Hf—Al—Co—Ni—Cu alloy systems that have significantly lower critical cooling rates in the range of from 1 to 100 K/s, and disclosed in U.S. Pat. No. 5,740,854 (Unites States Patent corresponding to JP-A 6-249254) that alloys of. Zr—Al—Ni—Cu alloy systems may be produced into a bulk amorphous alloy material with a size of up to 16 mm in diameter and 150 mm in length by quenching the melt in a quartz tube in water.

The inventors of the present invention also disclosed in U.S. Pat. No. 5,740,854 and JP-A 6-249254 that the resulting bulk amorphous alloy material has a tensile strength of as high as 1500 MPa comparable to the compressive strength and break (crack) accompanying serrated plastic flow in the tensile stress-strain curves, and that such high tensile strength and serrated plastic flow phenomenon result in excellent malleability despite the large thickness of the bulk amorphous alloy produced by casting.

On the bases of the above-described findings of the bulk amorphous alloy production, the inventors of the present invention have continued an intensive study to thereby develop a method that is capable of producing a glassy metal material of even larger size with various configurations by a simple procedure. As a consequence, the inventors proposed a process for producing metallic glass by suction casting wherein an amorphous alloy of large size having excellent properties can be readily produced in simple operation by instantaneously casting the molten metal material in a mold cooled with water.

Such process of metallic glass production by suction casting as disclosed in U.S. Pat. No. 5,740,854 and JP-A 6-249254 is capable of producing a columnar bulk amorphous alloy, and the thus produced columnar bulk amorphous alloy exhibits good properties. In this prior art process, however, the bottom of the water cooled crucible is moved downward at a high speed and the molten metal is instantaneously cast into a vertically extending water-cooled mold to thereby attain a high moving speed of the molten metal and a high quenching rate.

In such production process, the molten metal is fluidized with the surface of the molten metal becoming wavy, and the surface area of the molten metal is increased with the increased surface area contacting the outer atmosphere. In some extreme cases, the molten metal is fluidized into small separate bulk molten metal droplets before being cast into the vertically extending mold. Therefore, the surfaces of the molten metal often meet with each other upon casting of the molten metal into the vertically extending water-cooled mold, and the so called cold shuts or discontinuities are formed at the interfaces of the thus met interfaces. The resulting bulk amorphous alloy thus suffered from inferior properties at such cold shuts, and hence, the bulk amorphous alloy as a whole suffered from poor properties.

In addition, the metal material is melted in a water-cooled hearth, and the part of the metal in contact with the hearth is at a temperature below the melting point of the metal material even if the metal material is in molten state. The part in contact with the hearth, therefore, is likely to induce nonuniform nucleation. In the above-described suction casting, such part of the molten metal which may induce uniform nucleation is also cast into the vertically extending water-cooled mold and there is a fair risk of crystal nucleus formation in the corresponding part.

Furthermore, since the bottom of the water-cooled crucible is moved downward at a high speed, the process suffered from a fair chance of the molten metal entering into the gaps formed between moveable parts and the like to reduce the reproducibility. In some extreme cases, the entering molten material is even caught in such gaps and resulted in failure, stop, or incapability of operation.

In the meanwhile, use of an amorphous alloy material for the face of a golf club has been proposed since the clubface is required to have high strength, high toughness, and high impact strength, and golf clubs wherein an amorphous alloy is used for the face insert are commercially available and attention is being given to such golf clubs. Production of such golf club, however, has been associated with the problem of low yield of the amorphous alloy face free from defects such as cold shuts, and variation in the mechanical properties of the face due to the molding procedure. The golf club, therefore, suffered from high price of the face, variation in the properties, and high cost.

SUMMARY OF THE INVENTION

An object of the present invention is to obviate the problems of the prior art as described above, and to provide a golf club which has excellent club properties and which has an amorphous alloy clubface of desired shape free from the so-called cold shuts, that is the amorphous region formed by the meeting of the molten metal surfaces that has been cooled to a temperature below the melting point through contact with outer atmosphere. Preferably, the clubface is also free from crystalline region formed by growth of crystalline nucleus through nonuniform nucleation of the molten metal at a temperature below the melting temperature. Another object of the present invention is to provide a golf club which has been produced by a simple, single-step, highly reproducible process wherein the molten metal at a temperature above the melting point is selectively cooled at a rate higher than the critical cooling rate. A further object of the present invention is to provide a golf club which has excellent strength properties including high strength and high toughness as well as excellent shot properties realized by improving restitution efficiency upon hitting of the golf ball whereby the initial speed of the golf ball is increased to its maximum.

In order to attain the objects as described above, there is provided by the present invention a golf club with a club head having a metallic glass face wherein said metallic glass face is a metallic glass face of desired shape produced by filling a metal material in a hearth; melting said metal material by using a high-energy heat source which is capable of melting said metal material; pressing said molten metal which is at a temperature above the melting point of said metal material to deform the molten metal into the desired shape by at least one of compressive stress and shear stress at a temperature above the melting point, while avoiding the surfaces of the molten metal which are cooled to a temperature below the melting point of said metal material from meeting with each other during the pressing; and cooling said molten metal at a cooling rate higher than the critical cooling rate of the metal material simultaneously with or after said deformation to produce the metallic glass face.

The metallic glass face may preferably have a Vickers hardness of at least 300 Hv.

The metallic glass face may preferably have a Young's modulus in the range of 50 GPa to 150 GPa.

The metallic glass face may preferably have a thickness in the range of 1.5 mm to 4.5 mm.

The metallic glass face may preferably have a value of the product E×T of Young's modulus E (GPa) and thickness T (mm) in the range of 100 to 350.

The metallic glass face may preferably have a tensile strength of at least 1000 MPa.

There is also provided by the present invention a golf club wherein said molten metal at a temperature above the melting point of said metal material is pressed while avoiding not only the meeting of the surfaces of the molten metal which are cooled to a temperature below the melting point of said metal material with each other but also meeting of such molten metal surface with another surface cooled to a temperature below the melting point of said metal material.

The pressing and deforming of said molten metal is preferably accomplished by selectively rolling said molten metal which is at a temperature above the melting point of said metal material into plate shape or other desired shape with a cooled roll for rolling mounted on said hearth, while cooling simultaneously.

The metallic glass face is preferably a metallic glass face of plate shape or other desired shape produced by, after melting said metal material filled in the hearth, selectively rolling the molten metal which is at a temperature above the melting point rising over the hearth with simultaneous cooling by rotating said cooled roll and moving the hearth in relation to said high energy heat source and said cooled roll for rolling.

The hearth is preferably of elongated shape, and the metallic glass face comprises a plurality of metallic glass faces of plate shape or other de sired shape produced by continuously conducting the melting, the rolling of the molten metal which is at a temperature above the melting point, and the cooling by using said hearth of the elongated shape and moving said hearth in relation to said high energy heat source and said cooled roll for rolling to thereby serially produce metallic glass faces.

The cooled roll for rolling is preferably provided at the position corresponding to the hearth with a molten metal-discharging mechanism for discharging the molten metal which is at a temperature higher than the melting point from the hearth, said molten metal-discharging mechanism being fabricated from a material having low thermal conductivity.

The pressing and deforming of said molten metal is preferably accomplished by selectively transferring said molten metal which is at a temperature above the melting point of said metal material into a cavity of the desired shape in the mold provided near said hearth without fluidizing the molten metal, and pressing the molten metal with a cooled upper mold without delay to forge the molten metal into the desired shape together with simultaneous cooling.

The metallic glass face is preferably a metallic glass face of the desired shape produced by, after melting said metal material filled in the hearth, moving said hearth and said lower mold to right underneath said upper mold and descending the upper mold toward the lower mold without delay to thereby selectively transfer the molten metal which is at a temperature above the melting point into said lower mold where the molten metal is pressed and cooled for forging.

The upper mold is preferably provided at the position corresponding to the hearth with a molten metal-discharging mechanism for discharging the molten metal which is at a temperature higher than the melting point from the hearth, said molten metal-discharging mechanism being fabricated from a material having low thermal conductivity.

In the present invention, the phrase "meeting" of "the surfaces cooled" means the "meeting" of "the surfaces of the molten metal (which are) cooled to a temperature below the melting point of said metal material" in a narrower sense. In a broader sense, this phrase also include the case wherein "the surfaces of the molten metal (which are) cooled to a temperature below the melting point of said metal material" meet with "other surfaces cooled to a temperature below the melting point of said metal material" such as the surface of the hearth cooled by water. It should be noted that the phrase "the surfaces of the molten metal (which are) cooled to a temperature below the melting point of said metal material" are the surfaces of the molten metal (which are) cooled to a temperature below the melting point by contact with outer atmosphere, mold, hearth or the like.

The phrase "pressing a molten metal (which is) at a temperature above the melting point of said metal material to deform the molten metal, while avoiding the surfaces cooled to a temperature below the melting point of said metal material from meeting with each other during the pressing" used herein does not only mean the pouring of the molten metal maintained at a temperature above the melting point from the cooled hearth into the mold followed by pressing, while avoiding the formation of cold shuts which are formed by the meeting of the surfaces cooled to a temperature below the melting point of said metal material caused by fluidization or surface wave-formation. This phrase also includes use of a mold fabricated from a material such as quartz which is not thermally damaged at a temperature above the melting-point of the metal material, and heating of the lower mold to a temperature near the melting point, preferably, to a temperature above the melting point, followed by pouring of the metal molten with a high energy source, for example, a radio frequency heat source and maintained at a temperature above the melting point into the preliminarily heated lower mold without forming any surface which is cooled to a temperature below the melting point; and pressing with the cooled upper mold to thereby conduct the pressing and quenching at a rate above the critical cooling rate. Namely, if the metal material used is a material with an extremely low critical cooling rate, the metal molten in a quartz tube may be directly poured and cooled in water while maintaining its shape.

In other words, the cold shuts are formed when the pressing, deformation, compression., shearing of the molten metal are not conducted at a rate higher than the critical cooling rate and meeting of the cooled surface are not avoided. When a metal having a certain critical cooling rate, for example, 10° C./sec is used, an amorphous bulk alloy without cold shuts can be produced only when the time between the molten state and the deformation and the decrease in temperature attain the predetermined critical cooling rate (higher than 10° C./sec in this case); and the meeting of the cooled surface is avoided.

The term "desired shape" used herein refers to the shape of a clubface in view of the embedding of the face insert constituting the club head face and fixing with a fastener. This term is not limited to any particular shape as long as the metallic glass material has a shape proper for the clubface and is formed into clubface through pressing or forging by using an upper press roll or forging mold of various contour and a lower press surface or forging mold of various contour which are controlled and cooled in synchronism. Exemplary shapes include, a plate, an unspecified profile plate, a cylindrical rod, a rectangular rod, and an unspecified profile rod.

BRIEF DESCRIPTION OF THE DRAWINGS

FIG. 4*a* is a schematic view of the process wherein the metal material is melted, and FIG. 4*b* is a schematic view of the process wherein the molten metal is rolled and cooled.

FIG. 7*a* is a schematic view of the process wherein the metal material is melted, and FIG. 7*b* is a schematic view of the process wherein the molten metal is forged and cooled.

DETAILED DESCRIPTION OF THE INVENTION

Figure 1A:
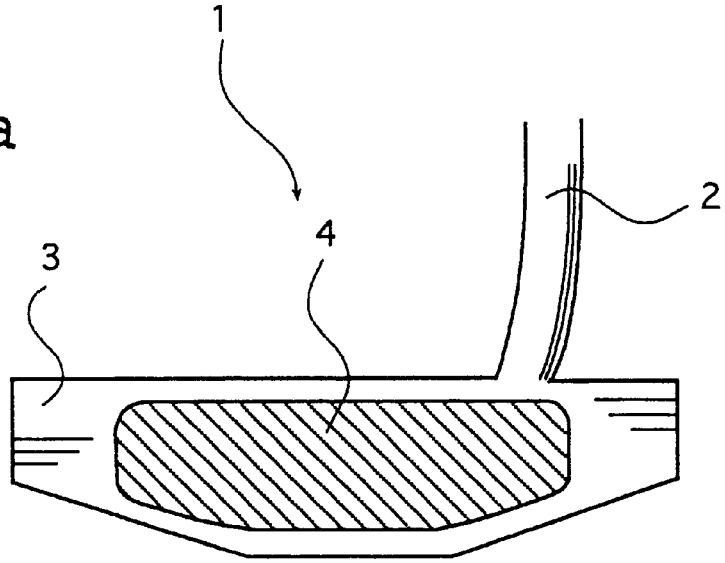
FIGS. 1*a* and 1*b* are respectively a schematic front view of an embodiment of the golf club according to the present invention, and a schematic perspective view of another embodiment of the golf club according to the present invention.

Next, the golf club of the present invention is described in detail by referring to the preferred embodiments described in the drawings.

Figure 1B:
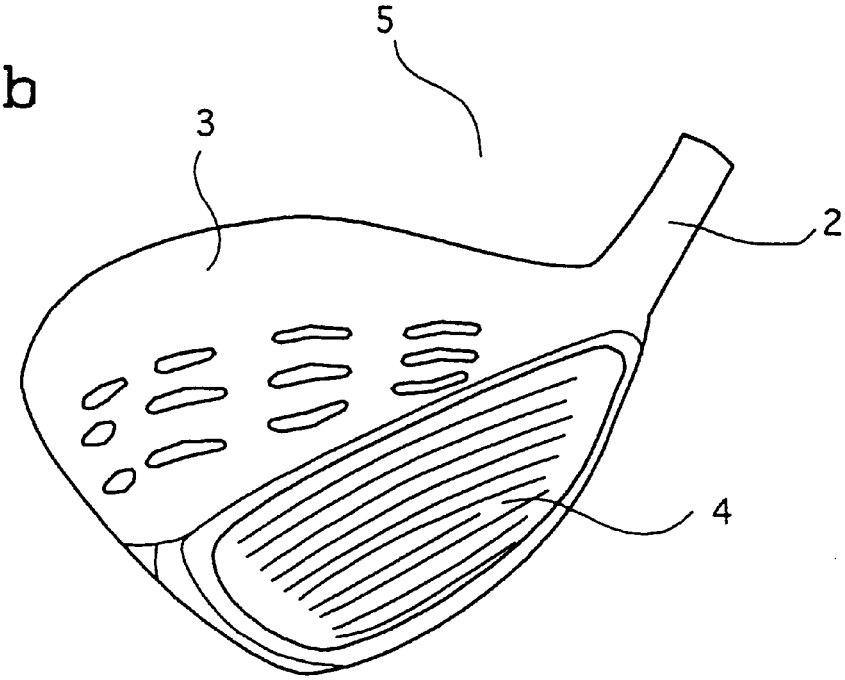

FIGS. 1*a* and 1*b* are respectively a schematic front view of an embodiment of the golf club according to the present invention, and a schematic perspective view of another embodiment of the golf club according to the present invention.

The golf club 1 of FIG. 1*a* is a so-called putter, and the golf club 1 has a neck 2 to be connected to a club shaft (not shown) and a head 3. The head 3 has a clubface in which a metallic glass face 4 is embedded as a face insert.

The golf club 5 of FIG. 1(*b*) is a so-called wood, and the golf club 5 also has a head 3 in which a metallic glass face 4 is embedded.

It should be noted that the golf club of the present invention is not limited to the putter 1 and the wood 5 shown in FIGS. 1*a* and 1*b*, and may be, for example, a so-called iron (not shown) and the like.

The characteristic feature of the golf club of the present invention is that the clubface of the head 3 in the golf club 1 or 5 has a metallic glass clubface 4, and all or a part of the clubface comprises the metallic glass face 4. In the present invention, the entire head 3 may be fabricated from a metallic glass as long as the clubface comprises the metallic glass face 4.

The head 3 wherein all or a part of the clubface is constituted from the metallic glass face 4, or the head 3 fabricated from a metallic glass may be produced by various means. For example, the metallic glass face 4 may be embedded in the head 3 as a face insert to constitute the clubface of the head 3 as shown in FIGS. 1*a* and 1*b*. In the case of the putter 1 shown in FIG. 1*a*, an iron (not shown), or the metal wood 5 (see FIG. 1*b*), the part of the head 3 on the side of the clubface may be fabricated from a metallic glass and the rest of the head 3 and the neck 2 may be fabricated from a metal normally used for constituting the head, and these parts may be connected. Alternatively, the entire head 3, or the head 3 and the neck 2 may be fabricated from a metallic glass. In the case of the wood as shown in FIG. 1*b*, the metallic glass face 4 may be fixedly secured onto the clubface of the head 3 by means of a fastener such as a bis.

It should be noted that the materials used for the head 3 of the golf club are not particularly limited, and an adequate material may be selected from metals such as iron and titanium and woods such as hickory which are generally used for a golf club.

The golf club 1 or 5 of the present invention has the metallic glass face 4 in the clubface of the head 3.

Preferably, the metallic glass face 4 used in the present invention is the one produced by the metallic glass production process as described below, and has the strength properties as described below.

The metallic glass face 4 used in the present invention may preferably have the mechanical properties as described below.

(1) The metallic glass face may preferably have a Vickers hardness Hv of at least 300 Hv.

When the value of Vickers hardness Hv is too small, the clubface will not have the scratch resistance required for a golf club face, and therefore, the metallic glass face may preferably have a Vickers hardness Hv of at least 300 Hv, and more preferably, at least 400 Hv. In view of the production process, the upper limit of the Vickers hardness Hv is 1300 Hv irrespective of the above-described lower limit of the Vickers hardness Hv.

(2) The metallic glass face may preferably have a Young's modulus E in the range of 50 GPa to 150 GPa.

When the Young's modulus E is too large, frequency corresponding to the primary local minimum value of the mechanical impedance of the golf club head will increase to detract from impedance matching (as described below) between the golf ball and the golf club. The traveling distance of the golf ball when hit with the golf club will then decrease, and the impact upon hitting of the ball will also increase to adversely affect the feel of the ball at impact. Therefore, the metallic glass face may preferably have a Young's modulus E of up to 150 GPa, and more preferably, up to 120 GPa. When the Young's modulus E is too small, deformation of the clubface upon hitting of the ball will be increased, and the golf club may suffer from a damage due to strength insufficiency, for example, at the joint between the face and the head main body. Therefore, the lower limit of the Young's modulus E is preferably 50 GPa, and more preferably 70 GPa irrespective of the above-described upper limit of the Young's modulus E.

One of the inventors of the present invention is an inventor of Japanese Patent No. 2130519 (JP-B 5-33071) which is directed to a golf club head wherein coefficient of restitution between the head and the golf ball is maximized to increase the shot distance. This patent discloses a theory (hereinafter sometimes referred to as impedance matching theory) wherein the initial speed of the impacted ball immediately after the shot is increased by minimizing the difference between frequency corresponding to the primary local minimum value of the mechanical impedance of the golf club head (hereinafter sometimes simply referred to as "primary frequency of the head impedance") and frequency corresponding to the primary local minimum value of the mechanical impedance of the golf ball (hereinafter sometimes simply referred to as "primary frequency of the ball impedance"; in the range of about 600 to 1600 Hz).

The term "mechanical impedance" is defined as the ratio of the magnitude of force acting on a point of a body to the response speed of another point when this force acts. That is to say, when an external force F is applied to a body, and the response speed of the body is V, the mechanical impedance Z is defined as: $Z=F/V$.

In order to reduce the primary frequency of the head impedance, it is effective to decrease the rigidity of the face surface or face portion, for example, by increasing the face area, reducing thickness of the face portion, and using a material of low Young's modulus for the face portion.

In particular, use of a metal material of low Young's modulus for the face portion is known from experience to result in a soft feel of the ball at impact (ball-impacting feel), and impact transmitted to hands in the case of a missed shot will also be reduced.

(3) The metallic glass face may preferably have a thickness T in the range of 1.5 mm to 4.5 mm.

When the face is too thick, the frequency corresponding to the primary local minimum value of the mechanical impedance of the golf club head will increase to detract from impedance matching between the golf ball and the golf club as described above. The distance of the golf ball travel when hit with the golf club will then decrease, and the impact upon hitting of the ball will also increase to adversely affect the feel of the ball at impact. Therefore, the metallic glass face may preferably have a thickness of up to 4.5 mm, more preferably up to 4.0 mm, and still more preferably up to 3.5 mm. When the face is too thin, the face will not have the strength required for a golf club face. Therefore, the lower limit of the face thickness T is 1.5 mm, and more preferably 2.0 mm irrespective of the above-described upper limit of the face thickness T.

(4) The metallic glass face may preferably have a value of the product E×T of the Young's modulus E (GPa) and the thickness T (mm) of the metallic glass face in the range of 100 to 350.

As described above, it is effective to "reduce the Young's modulus" or "reduce the face thickness" in order to increase the traveling distance of the golf ball by minimizing the difference between the frequency corresponding to the primary local minimum value of the mechanical impedance of the golf club head and the frequency corresponding to the primary local minimum value of the mechanical impedance of the golf ball, and at the same time, it is effective to "increase the Young's modulus" and "increase the face thickness" in order to reliably attain the strength required for a golf club face. In view of such balance, the E×T which is the product of the Young's modulus E (GPa) and the thickness T (mm) is preferably at least 100, more preferably at least 150, and still more preferably at least 170. At the same time, the E×T is preferably up to 350, and more preferably up to 340.

(5) The metallic glass face may preferably have a tensile strength σf of at least 1000 MPa.

When the tensile strength σf is too small, the face will not have the strength required for a golf club face, and the golf club may experience damages such as face crack upon impact. Therefore, the metallic glass face may preferably have a tensile strength σf of at least 1000 MPa, and more preferably at least 1200 MPa. The upper limit of the tensile strength σf is 5000 MPa, and more preferably 4000 MPa irrespective of the above-described lower limit of the tensile strength σf.

The metallic glass face 4 used in the present invention is provided with the preferable mechanical properties as defined above, and as a consequence, the golf clubs 1 and 5 of the present invention are provided with excellent properties and in particular, excellent shot properties including maximized initial ball speed by increased coefficient of restitution of the golf ball at impact.

The metallic glass face provided with the mechanical properties capable of realizing the shot properties as described above may be produced by the metallic glass production process as described below.

Next, the process for producing the metallic glass for the clubface of the present invention is described.

In the method of producing a metallic glass face used in the present invention, a hearth, for example, a water-cooled copper hearth in the form of a recess is filled with a face-constituting metal material which is preferably a mixture of a powder or pellets of metals having high amorphousizing properties. Next, the metal material is melted by means of a high energy heat source, for example, by an arc heat source after evacuating the chamber and maintaining the vacuum, or under reduced pressure, or after substituting the chamber with an inert gas with or without forced cooling of the hearth. (Melting in vacuum has the merit of retarded cooling of the molten metal due to the absence of convection compared to the casting at atmospheric pressure. The metal may be melted, for example, by means of electron beam.)

Next, the molten metal at a temperature above the melting point of the metal material is transferred into the cavity of the mold. More illustratively, in the case of the water-cooled hearth, the molten metal at a temperature above the melting point is selectively transferred into the mold cavity by directly pressing the molten metal in the hearth with a new mold or by transferring the molten metal mass into the mold cavity followed by pressing. In such transfer of the molten metal onto the mold cavity, the surfaces of the molten metal in contact with the atmosphere should be avoided from meeting with each other, and fluidization or surface weaving of the molten metal should be avoided. When the molten metal is pressed in the mold cavity, at least one of compression stress and shear stress is applied to the molten metal at a temperature higher than the melting temperature for deformation of the molten metal into the desired shape, and the molten metal at a temperature higher than the melting temperature is cooled at a rate higher than the critical cooling rate of the metal material after the deformation or simultaneously with the deformation.

For example, in an embodiment, the molten metal at a temperature above the melting point rising over the hearth is selectively rolled simultaneously with cooling into a face of plate or other desired shape by means of a cooled (water-cooled) roll for (metal) rolling disposed on the hearth (this process is referred to as (metal) rolling process). In this process, the hearth is moved in relation to the cooled roll for rolling which is rotated. When a hearth of an elongated shape is used, the metal material in the hearth may be melted in continuity by the high energy heat source in correspondence with the relative movement of the hearth, and the continuously melted metal at a temperature higher than the melting point is continuously rolled and cooled by the continuously rotating cooled roll for rolling to produce a train of metallic glass faces of elongeted plate shape or other desired face shape. It should be noted that the cooled roll for rolling is preferably provided with a molten metal-discharging mechanism fabricated from a material of low thermal conductivity at the position corresponding to the hearth to thereby discharge the molten metal at a temperature higher than the melting point from the hearth into the new mold surface (rolling surface) used for face production.

In another embodiment, the molten metal in the hearth at a temperature higher than the melting point of the metal material is selectively transferred into the lower half of the mold having a cavity of desired shape provided near the hearth without causing fluidization or surface weaving of the molten metal, and the molten metal is immediately pressed with the cooled upper half of the mold which mates with the cavity of the lower mold for press forging of the molten metal, or alternatively, the mold may be cooled simultaneously with the forging (this process is hereinafter referred to as forging process). In this process, the hearth and the lower mold are moved in relation to the high energy heat source and the upper mold to align the lower and the upper molds, and the lower and the upper molds are mated by either descending the upper mold or ascending the lower mold to press forge the molten metal in the lower mold at a temperature above the melting point simultaneously with the rapid cooling of the mold. It should be noted that the upper mold is preferably provided with a molten metal-discharging mechanism fabricated from a material of low thermal conductivity at the position corresponding to the hearth to thereby discharge the molten metal at a temperature higher than the melting point from the hearth into the cavity of the lower mold.

As mentioned above, the first object of the present invention is to produce and use an amorphous alloy face of the desired final face shape which is free from cold shuts and other casting defects, and which has excellent mechanical properties including strength and toughness; and the second object is, in addition to the fist object, to produce and use an amorphous alloy face which is free from crystal nuclei resulting from the nonuniform nucleation and which has uniform mechanical properties. Therefore, the means for attaining such objects are not limited to the above-described processes, and any means can be adopted as long as the molten metal as a mass at a temperature above the melting point can be selectively formed into the face of the final desired shape by directing compression stress and/or shear stress to the molten metal by pressing the molten metal while avoiding the meeting of the surfaces of the molten metal which had been in contact with the atmosphere by fluidization or surface weaving of the molten metal or the meeting of the preceding molten metal stream with the subsequent molten metal stream.

For example, most preferable means comprise the use of a levitation device or the like wherein the metal material is melted and maintained at a temperature above the melting point in non-contacted state, and the use of cold crucible (skull melting) device or the like wherein the metal material is melted and maintained at a temperature above the melting point in a state resembling the non-contacted state. Sections of a sectional die, for example, two sections of a mold are moved toward the molten metal maintained at a temperature above the melting point in non-contacted state or in a state resembling the non-contacted state to thereby sandwich and press the molten metal into the desired final face shape. In an alternative process, a material which does not melt at a temperature higher than the melting point of the metal material, which does not react with the molten metal, and which has excellent mechanical strength or a material which is not damaged by high temperature heating and rapid cooling is chosen in accordance with the type of the molten metal from such materials as carbon, nickel, tungsten, ceramics, and the like, and the lower half of the mold used for face production is fabricated from the thus selected material. The metal material is filled in the lower mold, melted, and pressed with the upper mold immediately after the melting of the metal material for press forming. Simultaneously with the pressing, the upper and lower molds may be cooled with a coolant such as a gas or water to produce the amorphous alloy face of desired final shape. In such a case, it is preferable that the lower mold is not cooled during the melting of the metal and the cooling of the lower mold is preferably started after the completion of the melting, and in such a case, the lower mold may be fabricated from any material as long as the lower mold can maintain the temperature near the melting point. For example, the lower mold may be fabricated from either a material of high conductivity or a material of low conductivity.

It should also be noted that, in the metal rolling process as described above, the metal rolling maybe conducted by two-roll. metal rolling process which is capable of producing an amorphous alloy face having desired surface pattern. In a single roll metal rolling process, the rolling and the cooling by the cooled roll for metal rolling may be accomplished not only by the reciprocal movement of the hearth in one direction but the hearth may be rotated within the horizontal plane so that the roll may be moved in different directions. In the forging process, the hearth and the lower mold may be rotated within the horizontal plane in addition to their reciprocal movement in one direction.

In the present invention, the metallic glass face of the desired final face shape is produced from the molten metal in one step. The number of the metallic glass face produced in one cycle, however, is not limited, and two or more faces may be produced at once. The term "final face shape" is used in the present invention for single face, two or more faces, a train of two or more faces, completely finished face(s), and face(s) which are yet to be worked (for example, from which burr should be removed).

An amorphous alloy face of plate shape or other shape, namely, a metallic glass face is thus produced. The metallic glass face thus produced which has not experienced nonuniform solidification is made of a high density bulk amorphous alloy which is free from cold shuts and other casting defects, which is free from crystal nuclei resulting from nonuniform nucleation, and which has uniform strength properties, in particular, impact strength, and toughness. Furthermore, the metallic glass face was produced by one-step molding and has a final desired shape adapted for the type of the golf club, and no further processing is required.

When a metal material is melted in a metallic hearth, in particular, in a water-cooled copper hearth to obtain the molten metal at a temperature above the melting point of the metal material, the part of the molten metal in contact with the hearth is inevitably cooled to a temperature below the melting temperature, and nonuniform nucleation is induced by this part of the molten metal where crystal nuclei are present. The resulting bulk material used as the face, therefore, is likely to be a bulk amorphous alloy wherein crystalline phase is present. Even if the crystalline phase were present in the bulk amorphous alloy, the material can be used as a functional material having both the functionality of the amorphous phase and the functionality of the crystalline phase, namely, as a functionally gradient material as long as the material is sufficiently functional and free from cold shuts and other casting defects. Such functionally gradient material is also within the scope of the amorphous bulk alloy which satisfies the requirements of the clubface in the golf club of the present invention.

The present invention maybe applied for the alloys of almost any combination of the elements including the above mentioned ternary alloys, Zr based alloys such as Zr—Al—Ni—Cu, Zr—Ti—Al—Ni—Cu, Zr—Nb—Al—Ni—Cu, and Zr—Al—Ni—Cu—Pd alloys and other multicomponent alloys comprising four or more components to form the amorphous phase, as long as these alloys can be melted using high energy heat source such as the arc heat source. When such alloys are used for the metal material of the invention, it would be preferable to use the alloy in powder or pellet form to facilitate rapid melting of the alloy by high energy heat source. The form of the alloy, however, is not limited to such forms, and the metal material used may be in any form as long as rapid melting is possible. Exemplary forms other than powder and pellets include wire, ribbon, rod, and ingot, and a metal material of any desired form may be adequately selected depending on the hearth, particularly the water-cooled hearth and the high-energy heat source employed.

The high-energy heat source used is not limited to any particular type, and any heat source may be employed so long as it is capable of melting the metal material filled in the hearth or the water-cooled hearth. Typical high-energy heat sources include arc heat source, plasma heat source, electron beam, and laser. When such heat source is employed, either single heat source or multiple heat sources may be provided per one hearth or one water-cooled hearth.

The metallic glass face in the golf club of the invention is basically produced by the method as described above. Next, the metallic glass production apparatus embodying the production process are described.

Figure 2:
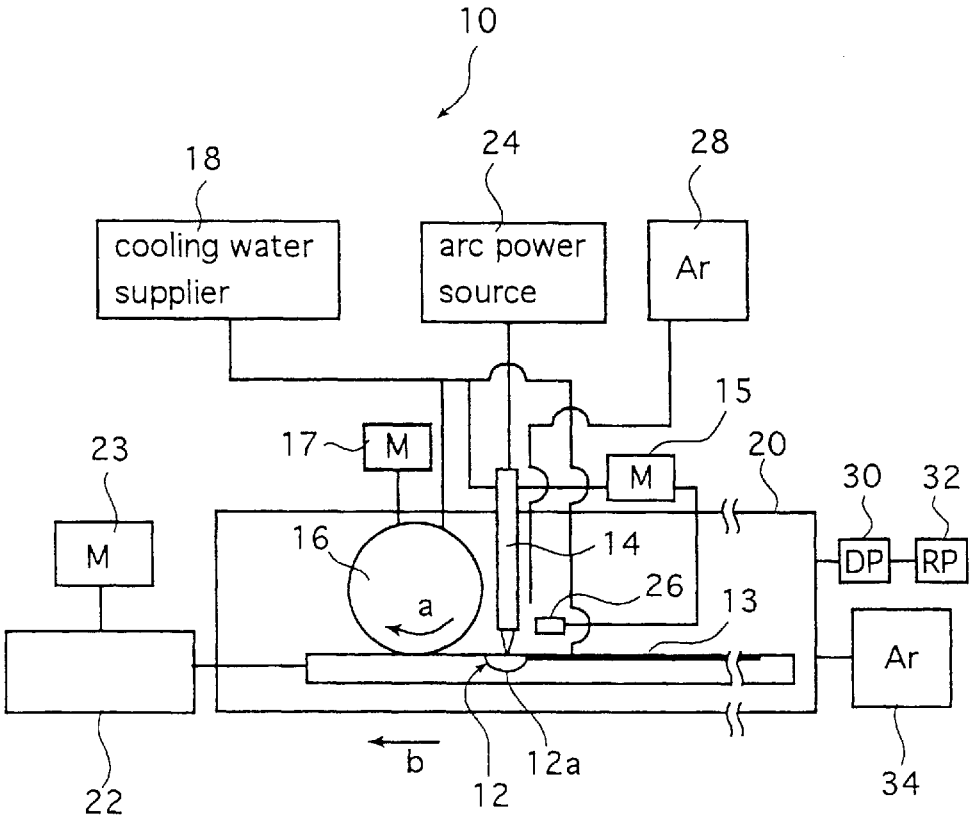
FIG. 2 is a flow sheet schematically showing an embodiment of the metallic glass production apparatus of rolling type used for producing a metallic glass face in the golf club of the present invention.

FIG. 2 is a flow sheet schematically showing an embodiment of the metallic glass production apparatus of metal rolling type used for producing the metallic glass face according to the present invention.

As shown in FIG. 2, the metallic glass production apparatus of rolling type 10 comprises a water-cooled copper hearth (hereafter referred to as a water-cooled hearth) 12 having a recess of predetermined configuration into which the metal material, for example, a metal material in powder or pellet form is to be filled; a roll casting section 13 extending from the periphery of the water-cooled hearth 12 and having a specified face shape; a water-cooled electrode (tungsten electrode) 14 for arc melting the metal material in the water-cooled hearth 12; and a water-cooled roll for rolling 16 for rolling the molten metal arc-melted at a temperature higher than the melting point rising from the water-cooled hearth 12 onto the roll casting section 13 to form an ingot of plate shape, and which rapidly cools the metal material at a rate higher than the critical cooling rate intrinsic to the metal material (molten metal) simultaneously with the rolling; a cooling water supplier 18 for supplying a cooling water to the water-cooled hearth 12, the water-cooled electrodes 14, and the water-cooled roll for rolling 16 by water circulation; a vacuum chamber 20 for accommodating the water-cooled hearth 12, the water-cooled electrodes 14, and the water-cooled roll for rolling 16; and a hearth-moving mechanism 22 for moving the water cooled hearth 12 provided with the roll casting section 13 in vacuum chamber 20 in the direction of arrow b (in horizontal direction) in synchronism with the rotation of the water-cooled roll for rolling 16 in the direction of arrow a.

The water-cooled roll for rolling 16 is rotated by a drive motor 17 to selectively roll and rapidly cool the molten metal at a temperature higher than the melting point rising from the water-cooled hearth 12 between the roll casting section 13 and the water-cooled roll for rolling 16, and the hearth-moving mechanism 22 is constructed so as to be driven by a drive motor 23 to horizontally move the water-cooled hearth 12 in synchronism with the rotation of the water-cooled roll for rolling 16. Although the water-cooled roll for rolling 16 is rotated by the drive motor 17 in the embodiment of FIG. 2, the embodiment shown in FIG. 2 is not a sole case and the present invention may be rotated by a mechanism other than such mechanism. For example, the water-cooled roll for rolling 16 may be kept in pressure contact with the water-cooled hearth 12 by means of a biasing means (not shown) such as a spring which can control the pressure, and the water-cooled roll for rolling 16 may be rotated by means of the friction between the water-cooled roll for rolling 16 and the water-cooled hearth 12 in correspondence to the horizontal movement of the water-cooled hearth 12 by the hearth-moving mechanism 22.

The water-cooled electrodes 14 is connected to an arc power source 24. The water-cooled electrodes 14 is arranged at a slight angle from the direction of the depth of the recess 12*a* of the water-cooled hearth 12, and the electrodes 14 is arranged to enable its control in X, Y and Z directions by a stepping motor 15. In order to keep the gap (in Z direction) between the metal material in the water-cooled hearth 12 and the water-cooled electrodes 14 at a constant distance, the position of the metal material may be detected by a semiconductor laser sensor 26 to automatically control the movement of the water-cooled electrodes 14 by the motor 15. When the gap between the arc electrodes 14 and the metal material is inconsistent, the arc established would be unstable, leading to inconsistency in the melt temperature. A nozzle for discharging a cooling gas (for example, argon gas) may be provided near the arc generation site of the water-cooled electrode 14 to discharge the cooling gas supplied from a gas source (a steel gas cylinder) 28 to thereby promote rapid cooling of the molten metal after the heat melting.

The vacuum chamber 20 has the structure of water-cooling jacket made from an SUS stainless steel, and is connected to an oil diffusion vacuum pump (diffusion pump) 30 and an oil rotary vacuum pump (rotary pump) 32 by means of the exhaust port for evacuation. The vacuum chamber 20 has an argon gas inlet port in communication with a gas source (a steel gas cylinder) 34 to enable purging of the atmosphere with the inert gas after drawing a vacuum. The cooling water supplier 18 cools the cooling water that has circulated back by means of a coolant, and then send the thus cooled cooling water to the water-cooled hearth 12, the water-cooled electrode 14, and the water-cooled roll for rolling 16.

The hearth-moving mechanism 22 which moves the water-cooled hearth 12 in the (horizontal) direction shown by arrow b in FIG. 2 is not limited to any particular mechanism, and any mechanism known in the art for translational or reciprocal movement may be employed, for example, a drive screw and a traveling nut using a ball thread, pneumatic mechanism such as air cylinder, and hydraulic mechanism such as hydraulic cylinder.

Figure 3:
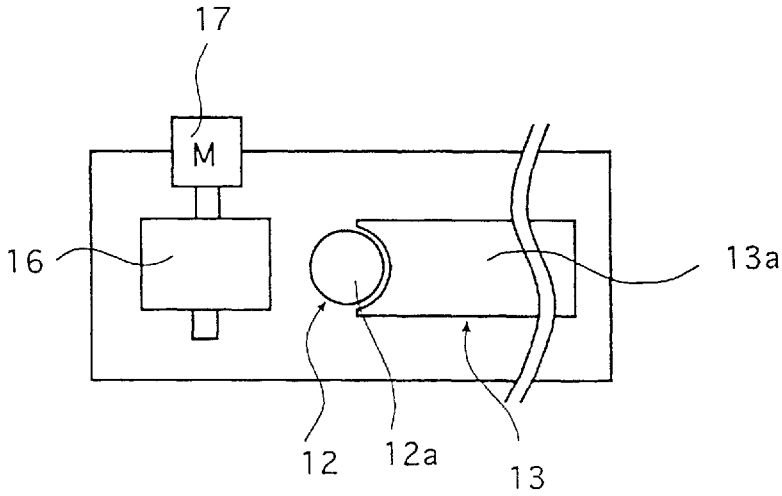
FIG. 3 is a top view of water-cooled hearth and mold used in the metallic glass production apparatus of rolling type shown in FIG. 2.

Next, the process for producing a metallic glass face by the rolling system according to the present invention is described by referring to FIGS. 2, 3 and 4.

Figure 4A:
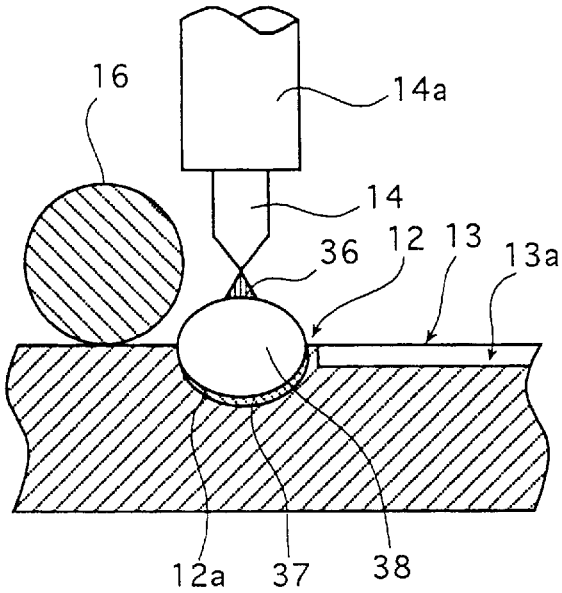
FIGS. 4*a* and 4*b* schematically show an embodiment of the production of a plate-shaped amorphous alloy face in the metallic glass production apparatus of rolling type wherein an arc electrode is used for the heat source.
Figure 4B:
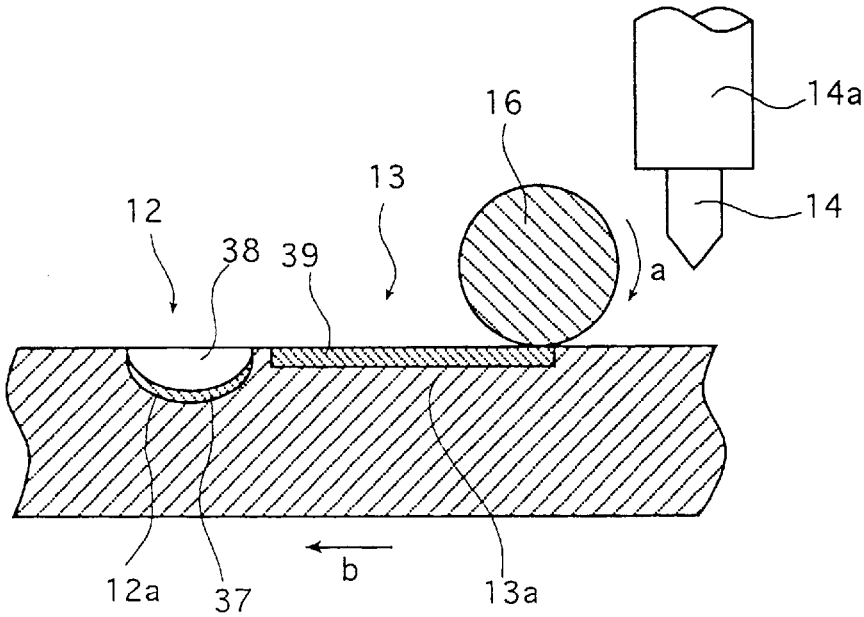

FIG. 3 is a schematic top view of the water-cooled copper hearth and the roll casting mold section (the mold. for rolling) 13 shown in FIG. 2. FIG. 4*a* is a schematic cross sectional view of the metal material-melting step in the production process of a plate shaped amorphous bulk alloy in the metallic glass production apparatus of rolling type wherein arc melting is employed. FIG. 4*b* is a schematic cross-sectional view of the step wherein the molten metal is rolled and cooled by the water-cooled roll for rolling 16 and the roll casting mold section 13 of the water-cooled copper hearth 12.

First, the water-cooled roll for rolling 16 is rotated by the drive motor 17, and the hearth-moving mechanism 22 is driven by the drive motor 23 in synchronism with the rotation of the water-cooled roll for rolling 16 to move the water-cooled hearth 12 to the initial position where it is set as shown in FIG. 4*a*. The metal material (powder, pellets, crystals) is then filled in the recess 12*a* of the water-cooled copper hearth 12. In the meanwhile, the position of the water-cooled electrode 14 is adjusted in X, Y and Z directions by means of the sensor 26 and the motor 15 via an adapter 14*a* (see FIGS. 4*a* and 4*b*) and the distance between the water-cooled electrode 14 and the metal material (in Z direction) is adjusted to a predetermined distance.

The chamber 20 is then evacuated by the diffusion pump 30 and the rotary pump 32 to a high vacuum of, for example, $5\times10^{-4}$ Pa (using liquid nitrogen trap), and argon gas is supplied to the chamber 20 from the argon gas source 34 to purge the chamber 20 with argon gas. In the meanwhile, the water-cooled copper hearth 12, the water-cooled electrode 14, and the water-cooled roll for rolling 16 are cooled by the cooling water supplied from the cooling water supplier 18.

When the preparation as described above is completed, the arc power source 24 is turned on to generate a plasma arc 36 between the tip of the water-cooled electrode 14 and the metal material to completely melt the metal material to form the molten alloy 38 (see FIG. 4*a*). The ark power source 24 is then turned off to extinguish the plasma ark 36. Simultaneously, the drive motors 17 and 23 are turned on to horizontally move the water-cooled copper hearth 12 by the hearth-moving mechanism 22 in the direction of the arrow b as shown in FIG. 4*b* at the predetermined rate, and rotate the water-cooled roll for rolling 16 at a constant rotation rate in synchronism with the horizontal movement of the water-cooled hearth 12 in the direction of the arrow a. The molten metal at a temperature above the melting point rising over the water-cooled hearth 12 is thus selectively transferred into the cavity (recess) 13*a* in the roll casting mold section 13 of the water-cooled hearth 12 by the water-cooled roll for rolling 16, and the thus transferred metal in the mold cavity 13*a* is rolled and pressed by sandwiching and pressing the molten metal between the roll casting section 13 and the water-cooled roll for rolling 16 at a predetermined pressure with simultaneous cooling. The metal liquid (molten metal) 38 is thus rolled by the water-cooled roll for rolling 16 into a thin plate simultaneously with the cooling, and therefore, the molten metal is cooled at a high cooling rate. Since the molten metal 38 is cooled at a rate higher than the critical cooling rate while it is rolled into the face having the final plate-like shape, the molten metal undergoes a rapid solidification to become the amorphous alloy face 39 of the final desired plate shape in the roll casting mold section 13.

The thus obtained amorphous alloy face 39 in the form of a plate is the one which has been selectively formed from the molten metal at a temperature above the melting point of the metal material (preferably, the molten metal of the part of the molten metal rising over the water-cooled hearth 12 which is at a temperature above the melting point) which is completely free from the portion 37 of the molten metal in the vicinity of the bottom of the water-cooled hearth 12 whose temperature is lower than the melting point of the metal material and which is likely to invite nonuniform nucleation, and hence formation of the crystalline phase. In addition, the plate shaped amorphous alloy face 39 is the one formed from the molten metal at once into the final plate form with simultaneous cooling, without causing any fluidization or surface weaving. Therefore, the molten metal is uniformly cooled and solidified, and the resulting amorphous alloy face 39 has high strength and toughness, and is free from the crystalline phase resulting from the nonuniform solidification or nonuniform nucleation as well as the casting defects such as cold shuts.

Figure 5A:
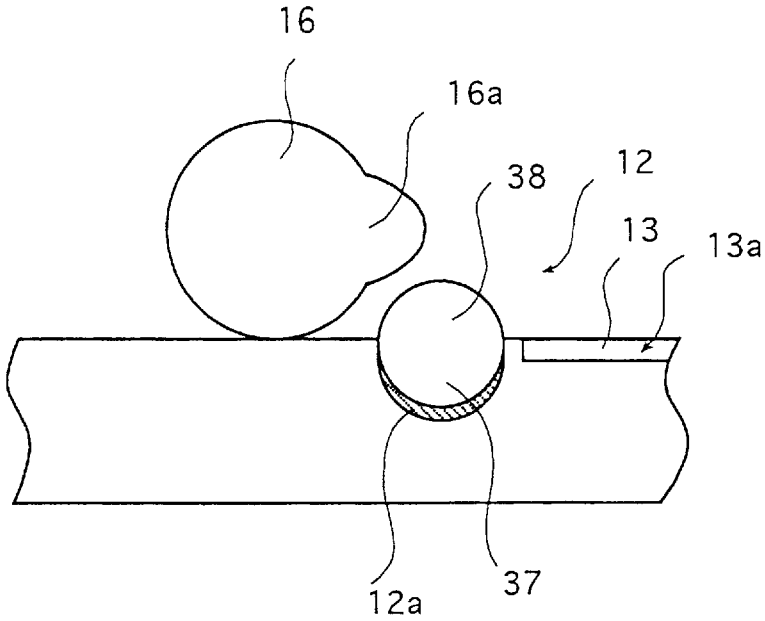
FIGS. 5*a* and 5*b* are partial cross-sectional and partial top views of essential parts of another embodiment of the metallic glass production apparatus of rolling type used in the present invention.

In the embodiment shown in FIGS. 4*a* and 4*b*, the portion 37 of the molten metal in the vicinity of the bottom of the water-cooled hearth 12 whose temperature is lower than the melting point is avoided from entering into the final product, and a plate-shaped amorphous alloy face 39 of high strength is reliably produced. In this embodiment, however, some of the molten metal 38 whose temperature is above the melting temperature of the metal material remains within the recess 12*a* of the water-cooled hearth 12, and such molten metal 38 is not used in the production of the plate-shaped amorphous alloy face 39, detracting from efficiency. Therefore, in an alternate embodiment of the present invention, as shown in FIG. 5*a*, the water-cooled roll for rolling 16 is provided with a molten metal-discharging mechanism 16*a* in the form of a protrusion fabricated from a material of low thermal conductivity at the position corresponding to the recess 12*a* of the water-cooled hearth 12 to thereby selectively discharge the molten metal at a temperature higher than the melting point from the recess 12*a* and prevent nonuniform nucleation. The molten metal 38 in the water-cooled hearth 12 at a temperature above the melting point is thereby efficiently utilized. In such embodiment, the protrusion constituting the molten metal-discharging mechanism 16*a* is preliminarily heated to a temperature near the melting temperature of the molten metal.

Figure 5B:
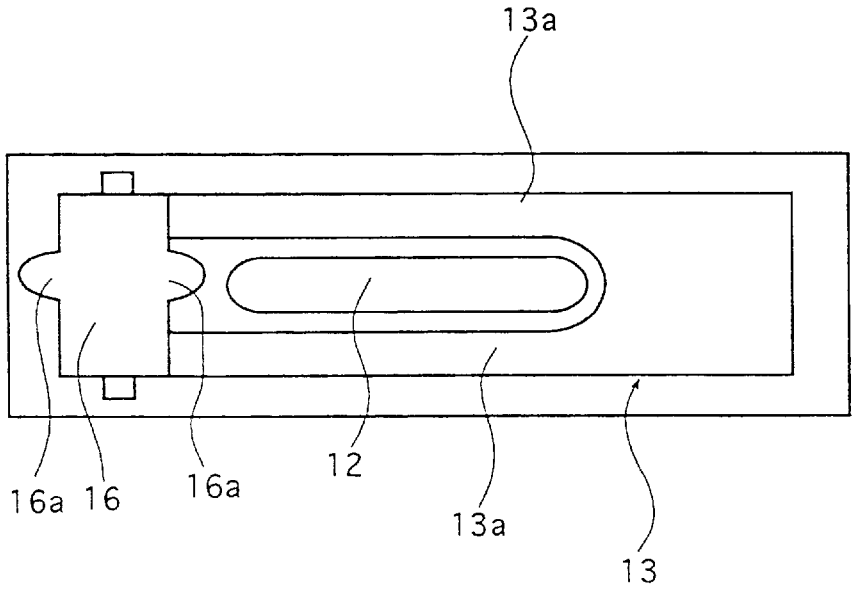

As shown in FIG. 5*b*, when the water-cooled hearth 12 (namely, the recess 12*a*) comprises an elongated recess 12*a* (of semicylindrical configuration), and the roll casting mold section 13 having a plurality of cavities 13*a* is provided on either side or both sides of the hearth 12, the metal material in the water-cooled hearth 12 may be continuously melted by the water-cooled electrode 14, and the molten metal at a temperature above the melting point may be selectively transferred by the water-cooled roll for rolling 16 into the cavities 13*a* of the roll casting mold section 13 of the water-cooled hearth 12 for continuous rolling with simultaneous cooling. As in the case of FIG. 5*a*, the water-cooled roll for rolling 16 of this embodiment may be provided with a molten metal-discharging mechanism 16*a*, for instance, on its periphery with a molten metal-discharging mechanism 16*a* in the form of a ridge of a predetermined length to selectively and effectively discharge the molten metal at a temperature higher than the melting point in the water-cooled hearth 12 to the cavities 13*a* and prevent nonuniform nucleation. As described above, the molten metal-discharging mechanism 16*a* in the form of a ridge is preferably fabricated from a material of low thermal conductivity, and more preferably, the molten metal-discharging mechanism 16*a* is preliminarily heated to a temperature near the melting temperature of the molten metal.

In the production process of rolling type for producing the metallic glass face according to the present invention, the roll casting mold section 13 is formed integrally with the water-cooled hearth 12. Instead of the roll casting mold section 13 integrally formed with the water-cooled hearth 12, another roll for rolling may be provided underneath the water-cooled roll for rolling 16 to constitute a twin-roll rolling system. In such a case, the cross section of the plate-shaped amorphous alloy face produced by the rolling may be changed by changing the contour of the lower roll, for example, the contour of the face-receiving cavity, into various shape not restricted to the rectangle shape.

In the embodiment as described above, the water-cooled roll for rolling 16 rotates with its axis of rotation remaining in the same position, and the position in the horizontal plane of the water-cooled electrode 14 is also substantially fixed. It is the water-cooled hearth 12 that is moved within its horizontal plane. The present invention is not limited to such an embodiment, and alternatively, the rotating water-cooled roll for rolling 16 and the water-cooled electrode 14 may be moved in parallel with each other in horizontal direction, and the water-cooled hearth 12 may be the fixed at one position.

Although the roll casting mold section 13 integrally formed with the water-cooled hearth 12 may be formed with a cavity 13*a* as shown in the drawing, and the lower roller of the twin-roll system may be also formed with the cavity 13*a*, the present invention is not limited to such types and the provision of the cavity is not always necessary as long as the molten metal 38 is adequately rolled.

In the embodiments as described above, the water-cooled roll for rolling 16 is strongly water cooled, and the roll casting mold section 13 and the lower roller of the twin-rolling system are not forcedly cooled. It is of course possible to forcedly cool the roll casting mold section 13 and the lower roller of the twin-rolling system. In addition, the water-cooled hearth 12, the water-cooled electrode 14 and the water-cooled roll for rolling 16 are forcedly cooled by cooling water. The present invention is not limited to such embodiment, and other cooling media (coolant) such as a coolant gas may be used.

The metallic glass face of the invention is basically produced with the rolling type production apparatus by the production process of rolling type as described above.

Next, the forging type production process of metallic glass face embodying the production of the metallic glass face used in the golf club of the present invention is described in detail.

Figure 6:
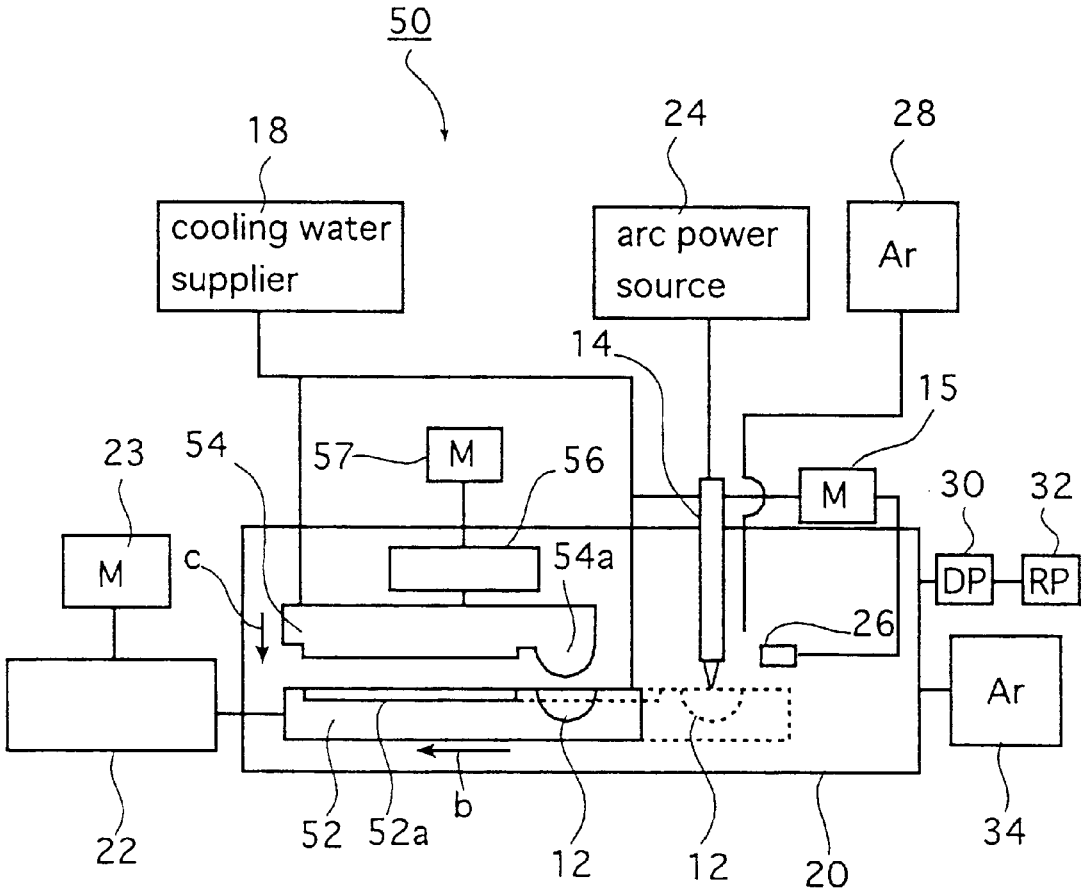
FIG. 6 is a flow sheet schematically showing an embodiment of the metallic glass production apparatus of the forging type for producing a metallic glass face used in the present invention.

FIG. 6 is a flow sheet schematically showing an embodiment of the metallic glass production apparatus of forging type for producing the metallic glass face used in the present invention.

As shown in FIG. 6, the metallic glass production apparatus of forging type 50 is similar to the metallic glass production apparatus of rolling type 10 in FIG. 2 except that the molten metal at a temperature above the melting point is press formed (forged, or cast forged) between the lower mold 52 provided near the water cooled hearth 12 and the rapidly cooled upper mold 54 instead of the roll casting mold section 13 integrally formed with the water cooled hearth 12 and the water-cooled roll for rolling 16. Same reference numerals are used for the elements common to the apparatus 50 and the apparatus 10, and the explanation is omitted.

As shown in FIG. 6, the metallic glass production apparatus of forging type 50 comprises a water-cooled hearth 12; a water-cooled electrode 14; a lower mold 52 having a cavity 52*a* having the desired final face configuration provided near the water-cooled hearth 12; a molten metal-discharging mechanism 54 for discharging the molten metal at a temperature higher than the melting point from the water-cooled hearth 12 into the cavity 52*a* of the lower mold 52, while avoiding nonuniform nucleation; an upper mold 54 which mates with the cavity 52*a* of the lower mold 52 to press mold (forge) the molten metal in the cavity 52*a* at a temperature above the melting point with simultaneous quenching of the molten metal at a rate higher than the critical cooling rate intrinsic to the metal material (molten metal); a cooling water supplier 18 for supplying a cooling water to the water-cooled hearth 12, the water-cooled electrodes 14, and the upper mold 54 by water circulation; a vacuum chamber 20 for accommodating the water-cooled hearth 12, the water-cooled electrodes 14, and the upper mold 54; a hearth-moving mechanism 22 for moving the water cooled hearth 12 integrally formed with the lower mold 52 in vacuum chamber 20 in the direction of arrow b (in horizontal direction) in order that the position of the lower mold 52 is set just below the upper mold 54; and an upper mold-moving mechanism 56 for moving the upper mold 54 in the direction of arrow c (in vertical direction) in the vacuum chamber 20 to thereby selectively discharge the molten metal at a temperature above the melting point in the water-cooled hearth 12 (integrally formed with the lower mold 52 which has been moved to the position of press molding) into the cavity 52*a* of the lower mold 52 by means of the molten metal-discharging mechanism 54*a* provided with the upper mold 54, and selectively press mold (forge) the molten metal at a temperature above the melting point in the cavity 52*a* simultaneously with quenching. The upper mold-moving mechanism 56 for vertical movement of the upper mold 54 is driven by the drive motor 57.

Next, the process for producing a metallic glass face by the forging type according to the present invention is described by referring to FIGS. 6 and 7.

Figure 7A:
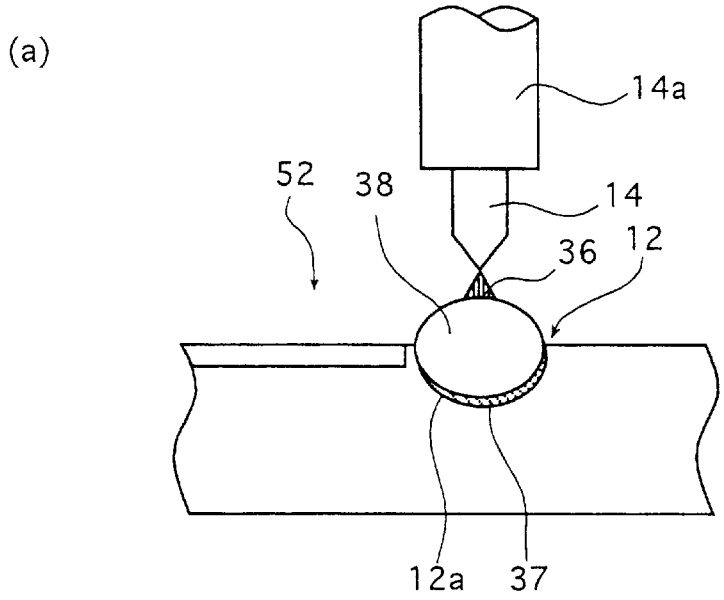
FIGS. 7*a* and 7*b* schematically show an embodiment of the production of a plate-shaped amorphous alloy face in the metallic glass production apparatus of the forging type wherein an arc electrode is used for the heat source.
Figure 7B:
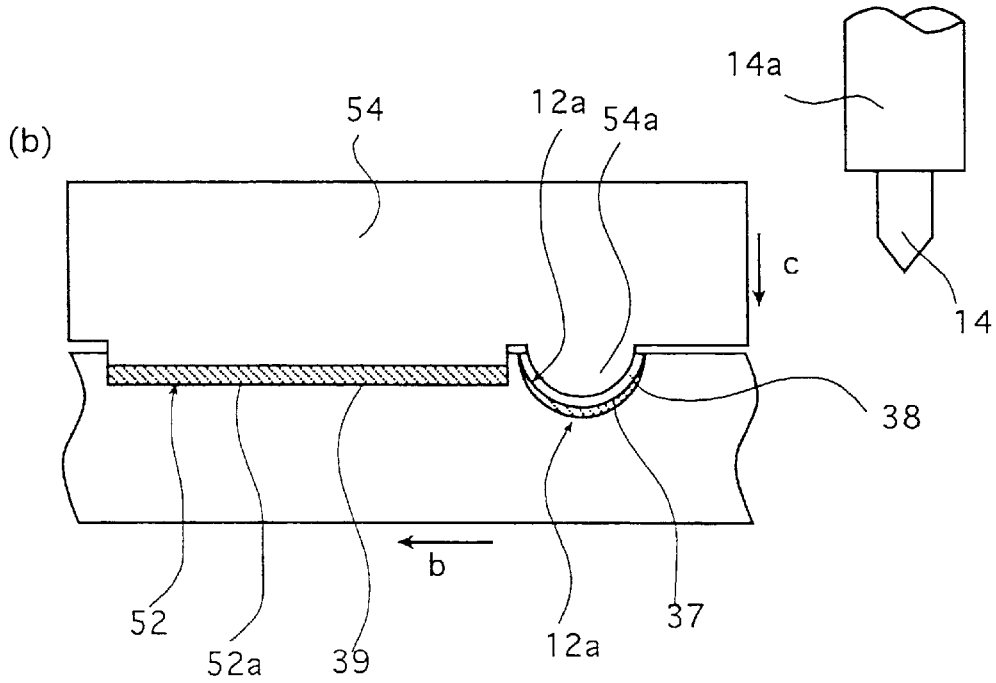

FIG. 7*a* is a schematic cross sectional view of the metal material-melting step in the production process wherein an amorphous alloy face of the desired final shape is produced in the metallic glass production apparatus of forging type utilizing arc melting. FIG. 7*b* is a schematic cross-sectional view of the step wherein the molten metal is forged and cooled between the upper mold 54 and the lower mold 52 integrally formed with the water-cooled copper hearth 12.

In the metallic glass production apparatus of forging type 50, the upper mold-moving mechanism 56 and the hearth-moving mechanism 22 are respectively driven by the drive motors 57 and 23 to move the water-cooled hearth 12 integrally formed with the lower mold 52 and the upper mold 54 to the initial position where they are set as shown in FIG. 7*a*. As in the case of the metallic glass production apparatus of rolling type 10, the metal material is then filled in the recess 12*a* of the water-cooled copper hearth 12, whereby the preparation for the metallic glass production by forging is completed.

After the completion of such preparation, the arc power source 24 is turned on as in the case of the metallic glass production apparatus of rolling type 10 to generate a plasma arc 36 between the tip of the water-cooled electrode 14 and the metal material to completely melt the metal material to form the molten alloy 38 (see FIG. 7*a*). The arc power source 24 is then turned off to extinguish the plasma arc 36. Simultaneously, the drive motor 23 is turned onto horizontally move the water-cooled copper hearth 12 at a constant speed by the hearth-moving mechanism 22 in the direction of arrow b to the position of press molding just below the upper mold 54 shown in FIG. 7*b*. In the meanwhile, the drive motor 57 is turned on to descend the upper mold 54 in the direction of the arrow c by the upper mold-driving mechanism 56.

As the upper mold 54 descends, the molten metal-discharging mechanism 54*a* selectively discharges the molten metal at a temperature above the melting point from the water-cooled hearth 12 and the thus discharged molten metal is forcedly pressed into the cavity 52*a* of the desired final face shape in the lower mold 52 integrally formed with the water-cooled hearth 12. The molten metal discharged by the molten metal-discharging mechanism 54*a* from the water-cooled hearth 12 and forcedly pressed into the cavity 52*a* is completely free from the portion 37 of the molten metal in the vicinity of the bottom of the water-cooled hearth 12 whose temperature is lower than the melting point of the metal material and which is likely to invite nonuniform nucleation, and hence, formation of the crystalline phase, and the defect such as nonuniform nucleation of the amorphous alloy face can be prevented. It should be noted that the molten metal-discharging mechanism 54*a* in the form of a protrusion or ridge is preferably fabricated from a material of low thermal conductivity, and more preferably, the molten metal-discharging mechanism 54*a* is preliminarily heated to a temperature near the melting temperature of the molten metal.

The upper mold 54 continues to descend and meets with the lower mold 52, and the upper mold 54 mates with the cavity 52*a* of the lower mold 52. The molten metal at a temperature above the melting point in the cavity 52*a* is thereby press molded as it is sandwiched between the upper and lower molds 54 and 52 at a predetermined pressure. In other words, the molten metal is forged by compression stress simultaneously with the rapid cooling by the water-cooled upper mold 54. The metal liquid (molten metal) 38 is thus press molded (forged) into the desired final face shape by the upper and lower molds 54 and 52 together with the cooling, and a high cooling rate of the molten metal is thereby realized. Since the molten metal 38 is cooled at a rate higher than the critical cooling rate while it is press molded (forged) into its final plate shape, the molten metal undergoes rapid solidification to become the amorphous alloy face 39 of the final desired thin plate shape.

The thus obtained amorphous alloy face 39 in the form of a thin plate is the one which has been selectively formed from the molten metal at a temperature above the melting point of the metal material which is completely free from the portion 37 of the molten metal in the vicinity of the bottom of the water-cooled hearth 12 whose temperature is lower than the melting point of the metal material, and which is likely to invite nonuniform nucleation, and hence formation of the crystalline phase. In addition, the plate shaped amorphous alloy face 39 is the one formed from the molten metal at once into the desired final face shape with simultaneous cooling, without causing any fluidization or surface weaving. Therefore, the molten metal is uniformly cooled and solidified, and the resulting amorphous alloy face 39 having high strength and high toughness is free from the crystalline phase resulting from the nonuniform solidification or nonuniform nucleation as well as the casting defects such as cold shuts.

In the embodiment as described above, the position in the horizontal plane of the water-cooled electrode 14 and the upper mold 54 are substantially fixed, and it is the water-cooled hearth 12 that is moved within its horizontal plane. The present invention is not limited to such an embodiment, and alternatively, the water-cooled electrode 14 and the upper mold 54 may be moved in parallel with each other in horizontal direction, and the water-cooled hearth 12 may be the fixed at one position. In the embodiment as described above, the horizontally moved water-cooled hearth 12 is provided with only one pair of the water-cooled hearth 12 and the lower mold 52. The present invention is not limited to such an embodiment, and two or more pairs of the hearth 12 and the lower mold 52 may be radially arranged at a predetermined interval on a rotatable disk so that the rotatable disk may be incrementally rotated. A continuous forging system of rotatable disk type is thereby constituted to enable successive forging one after another by incremental rotation of the rotatable disk. Of cause, the rotatable disk may be provided with only one pair of the water-cooled hearth 12 and the lower mold 52, and the one or more pair of the water-cooled hearth 12 and the lower mold 52 may be provided not only on the rotatable disc but also on a plate of other configuration such as a rectangular plate as long as the pairs of the water-cooled hearth 12 and the lower mold 52 can be arranged on the plate and the plate is rotatable.

In the embodiments as described above, the upper mold 54 is strongly water cooled, and the lower mold 52 and the like are not forcedly cooled. It is of course possible to forcedly cool the lower mold 52 and the like. In addition, the water-cooled hearth 12, the water-cooled electrode 14 and the upper mold 54 are forcedly cooled by cooling water. The present invention is not limited to such embodiment, and other cooling media (coolant) such as a coolant gas may be used.

The upper mold-moving mechanism 56 which presses the upper mold 54 onto the lower mold 52 is not limited to any particular mechanism, and any mechanism known in the art, for example, a hydraulic or pneumatic mechanism may be employed.

The metallic glass face of the invention is basically produced with the forging type production apparatus by the production process of forging type as described above.

The golf club of the present invention has been described in detail by referring to various embodiments. The present invention, however, is not limited to such embodiments, and various modifications and design changes within the scope of the present invention should occur to those skilled in the art.

As described above in detail, the golf club of the present invention utilizes an amorphous alloy clubface of the desired shape and preferably, an amorphous alloy clubface of the desired final shape which is free from casting defects such as cold shuts and which exhibits excellent strength properties. The amorphous alloy clubface is produced by a simple, one step, highly reproducible procedure. The golf club of the present invention exhibits good shot properties including the shot distance and direction since the excellent impact properties and the excellent strength properties including strength and toughness are fully utilized, and impact between the golf ball and the clubface in the shot is highly reproducible and reliable.

In addition, the golf club of the present invention utilizes an amorphous alloy clubface of the desired face shape with excellent strength properties as well as excellent shot properties. The amorphous alloy clubface is solely constituted from the amorphous phase which is free from crystalline phase formed by the development of the crystalline nuclei through nonuniform nucleation inherent to the molten metal at a temperature below the melting temperature since the amorphous alloy clubface is produced in a simple, single-step process by selectively cooling the molten metal at a temperature above the melting temperature at a cooling rate higher than the critical cooling rate of the metal material. Therefore, the golf club of the present invention can be produced with minimized variation in the properties.

EXAMPLES

Next, the metallic glass face and the golf club utilizing the metallic glass face according to the present invention are described in greater detail by referring to the Examples.

Examples I-1 to I-14

The metallic glass production apparatus of forging type 50 shown in FIGS. 6 and 7 was used to produce rectangular amorphous alloy face plates with various dimensions in the range of 100 mm (length)×30 mm (width)×2 to 20 mm (thickness) from the 14 alloys shown in Table 1.

In the Examples, the water-cooled copper hearth 12 was a semispherical recess with a dimension of 30 mm (diam.)×4 mm (depth), and the face receiving cavity 52*a* of the lower mold 52 was a rectangular recess with a dimension of 210 mm (length)×30 mm (width)×2 to 20 mm (depth).

The water-cooled (arc) electrode 14 used was the one which is capable of fully utilizing the arc heat source of 3,000° C. and controlling the temperature by means of an IC cylister. The argon gas for cooling was injected from a cooling gas-injection port (not shown) provided on the adapter 14*a*. The water-cooled electrode 14 had an arc generating site comprising thorium-containing tungsten, and therefore, electrode consumption and contamination was minimized. The electrode 14 also had a water-cooled structure which mechanically and thermally enabled stable, continuous operation at a high thermal efficiency.

In these Examples, the metallic glass production apparatus of forging type 50 was operated by the conditions as described below. The electric current and the voltage employed for the arc melting were 250 A and 20 V, respectively. The gap between the water-cooled electrode 14 and the metal material in the form of a powder or pellets was adjusted to 0.7 mm. The pressure applied to the upper mold 54 for the press molding was in the range of 5 M to 20 Mpa and was changed depending on the thickness of the rectangular amorphous alloy face plates.

The rectangular amorphous alloy face plates produced by the forging process as described above were examined for their structure by X-ray diffractometry, optical microscopy (OM), scanning electron microscopy combined with energy diffusion X-ray spectroscopy (EDX). The samples for use in the optical microscopy (OM) were subjected to an etching treatment in 30% hydrofluoric acid solution at 303K for 1.8 ks. The samples were also evaluated for their structural relaxation, glass transition temperature (Tg), crystallization temperature (Tx), and heat of crystallization (ΔHx: temperature range of the supercooled liquid region) by differential scanning calorimetry (DSC) at a heating rate of 0.67 K/s. The rectangular amorphous alloy plate samples were also evaluated for mechanical properties. The mechanical properties evaluated were tear energy (Es), Vickers hardness (Hv), tensile strength (σf) (tensile strength could not be measured for the Examples 4, 5, 10 and 11, and compression strength was measured), elongation (εf), and Young's modulus (E). The Vickers hardness (Hv) was measured by Vickers microhardness tester at a load of 100 g.

The alloy composition of the 14 alloys used for the production of the rectangular amorphous alloy face plates are shown in Table 1 together with the properties of the rectangular amorphous alloy face plates. It should be noted that "t" in Table 1 stands for the thickness of the rectangular amorphous alloy face plates.

TABLE 1

| Example No. | Alloy Composition | Es ($kJ/m^2$) | t (mm) | Tg (K) | TX (K) | ΔTX (K) | Hv | δf (MPa) | εf (%) | E (GPa) |
|---|---|---|---|---|---|---|---|---|---|---|
| 1 | $Zr_{62.5}Al_{7.5}Cu_{20}$ | 66 | 8 | 623 | 750 | 127 | 510 | 1730 | 2.0 | 86 |
| 2 | $Zr_{57}Ti_3Al_{10}Ni_{10}Cu_{20}$ | 59 | 5 | 655 | 740 | 85 | 540 | 1800 | 1.8 | 88 |
| 3 | $Zr_{60}Al_{10}Cu_{30}$ | 67 | 5 | 620 | 708 | 88 | 490 | 1650 | 3.1 | 77 |
| 4 | $Fe_{56}Cu_7Ni_7Zr_{10}B_{20}$ | — | 4 | 810 | 883 | 73 | 1250 | *3560 | 1.8 | 160 |
| 5 | $Fe_{56}Cu_7Ni_7Zr_2Nb_8B_{20}$ | — | 3 | 805 | 892 | 87 | 1290 | *3630 | 2.0 | 167 |
| 6 | $Mg_{75}Cu_{15}Y_{10}$ | — | 5 | 424 | 471 | 47 | 250 | 880 | 1.9 | 47 |
| 7 | $Mg_{70}Ni_{20}La_{10}$ | — | 5 | 470 | 503 | 33 | 300 | 900 | 2.1 | 50 |
| 8 | $La_{65}Al_{15}Ni_{20}$ | — | 5 | 180 | 240 | 60 | 370 | 1210 | 2.0 | 58 |
| 9 | $La_{65}Al_{15}Cu_{20}$ | — | 5 | 175 | 233 | 58 | 355 | 1120 | 2.2 | 56 |
| 10 | $Co_{56}Fe_{14}Zr_{10}B_{20}$ | — | 2 | 810 | 838 | 28 | 1050 | *2850 | 1.7 | 150 |
| 11 | $Co_{51}Fe_{21}Zr_8B_{20}$ | — | 2 | 800 | 884 | 84 | 1080 | *3010 | 1.8 | 153 |
| 12 | $La_{55}Al_{15}Ni_{10}Cu_{20}$ | 72 | 7 | 210 | 288 | 78 | 360 | 1150 | 2.2 | 56 |
| 13 | $Pd_{40}Cu_{30}Ni_{10}P_{20}$ | 70 | 15 | 580 | 678 | 98 | 550 | 1760 | 2.1 | 78 |
| 14 | $Zr_{55}Al_{10}Cu_{30}Ni_5$ | 68 | 20 | 680 | 760 | 80 | 540 | 1680 | 2.2 | 85 |

*Compaction strength

Figure 8:
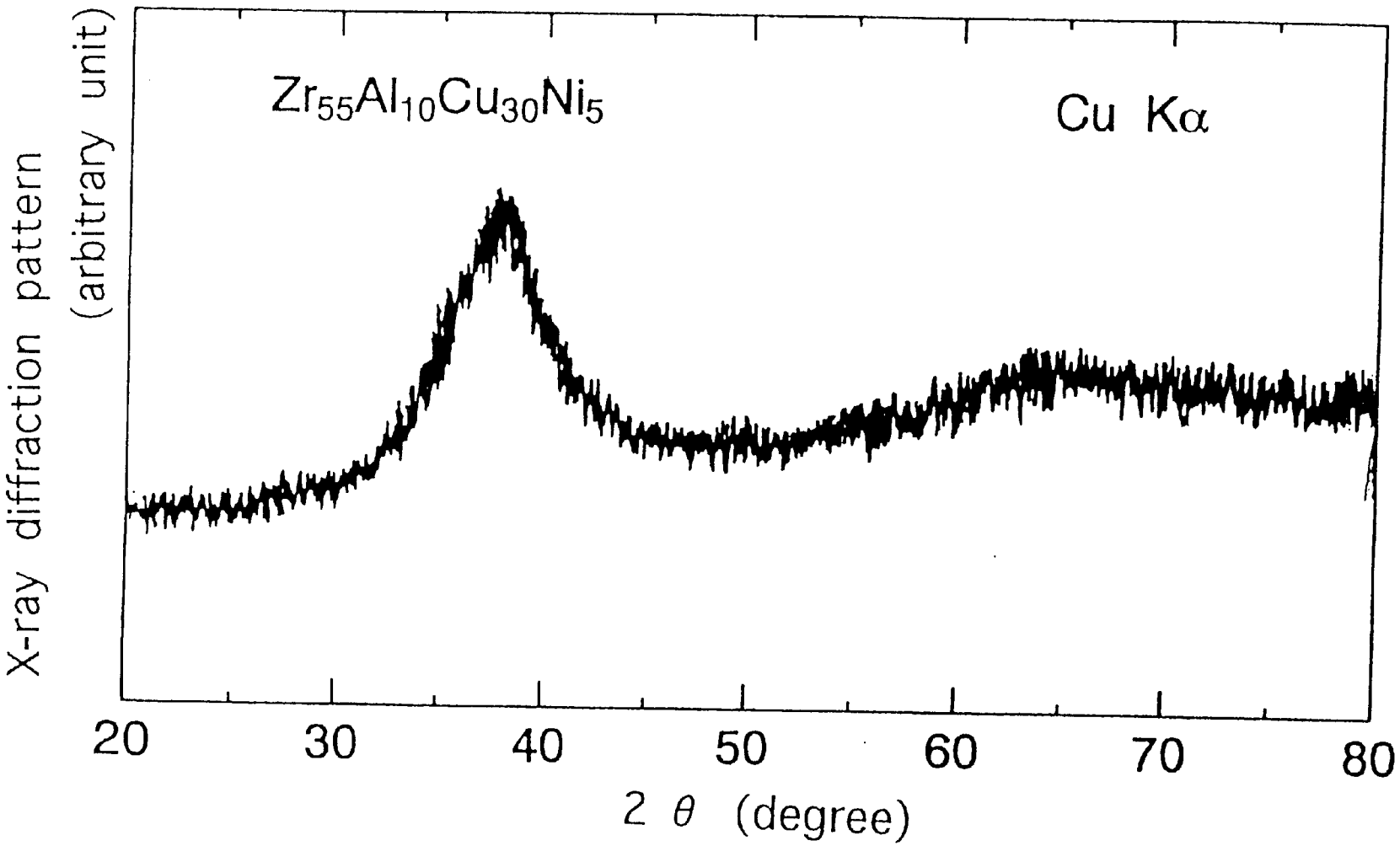
FIG. 8 is an X-ray diffraction pattern for the piece taken from the central region of the transverse section of the $Zr_{55}Al_{10}Cu_{30}Ni_5$ alloy material produced in Example 14 of the present invention.
Figure 9:
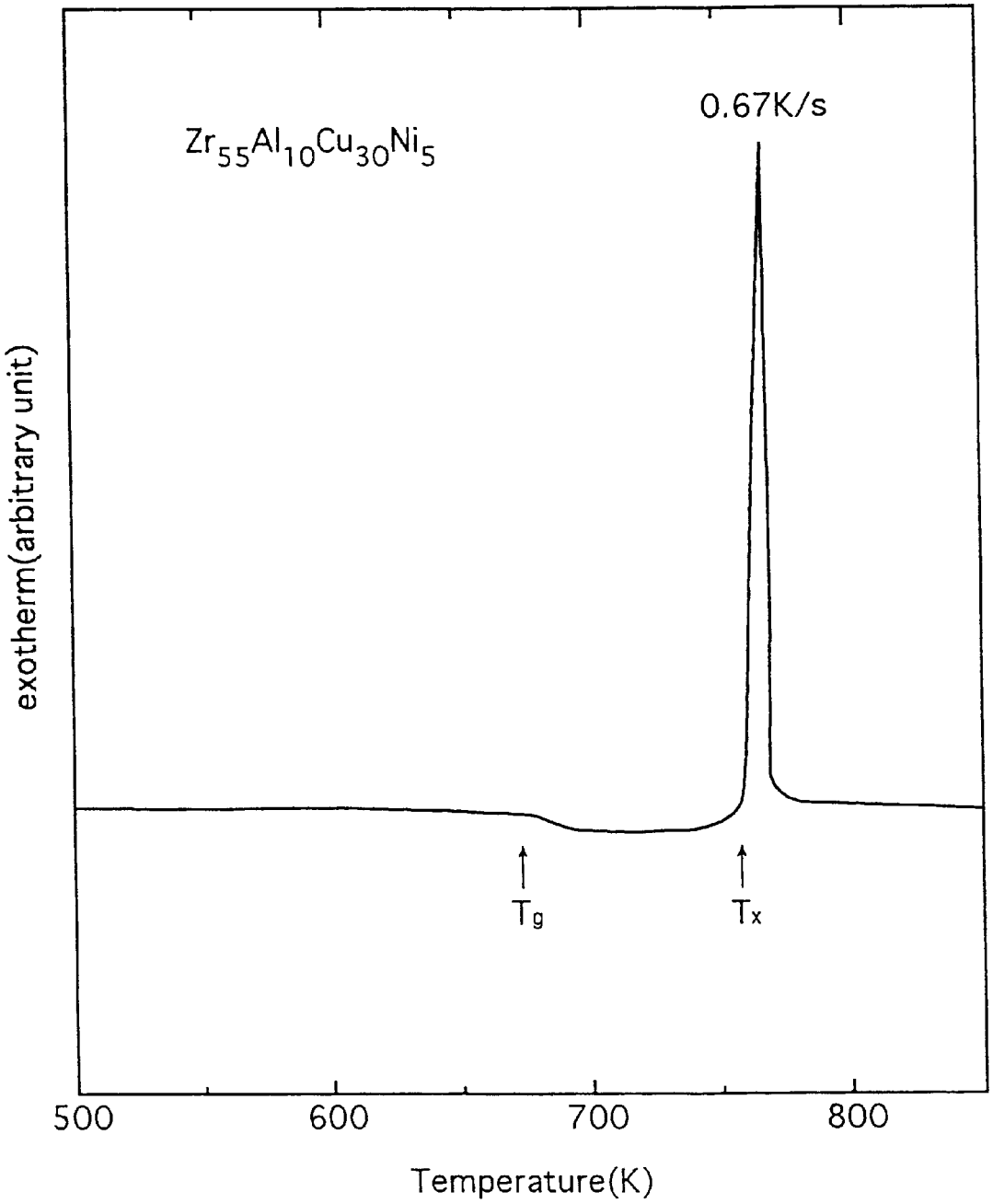
FIG. 9 is differential scanning calorimetry curve for the piece taken from the central region of the transverse section of the $Zr_{55}Al_{10}Cu_{30}Ni_5$ alloy material produced in Example 14 of the present invention.
Figure 10:
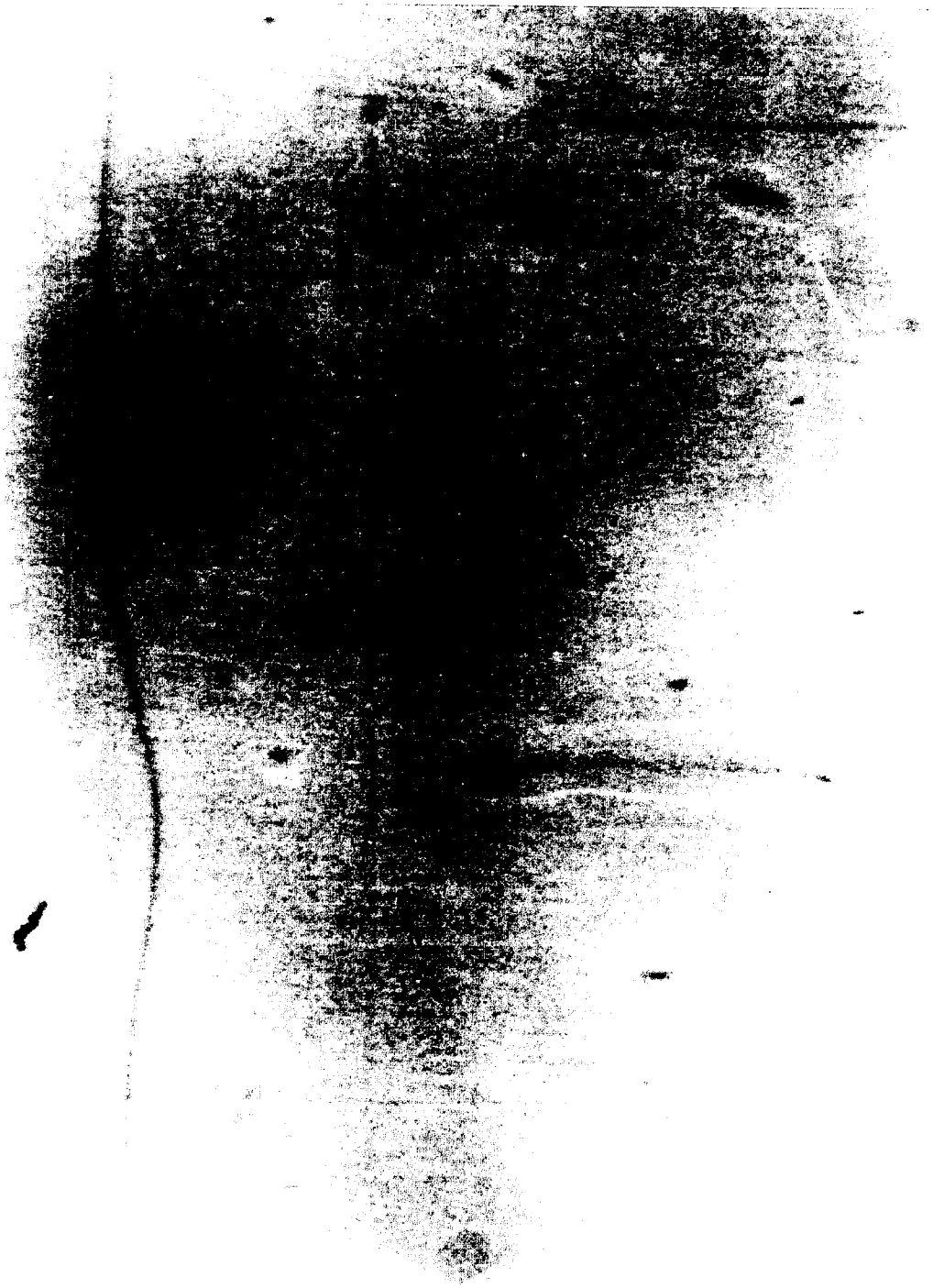
FIG. 10 is a photomicrograph showing the metal structure in the central region of the transverse section of the $Zr_{55}Al_{10}Cu_{30}Ni_5$ alloy material produced in Example 14 of the present invention.

The results of the X-ray diffractometry, measurements of heat of crystallization, photomicrograph (×500) for the $Zr_{55}Al_{10}Cu_{30}Ni_{15}$ alloy material produced in Example 14 are shown in FIGS. 8, 9 and 10, respectively.

FIG. 8 represents X-ray diffraction patterns of the $Zr_{55}Al_{10}Cu_{30}Ni_{15}$ alloy material produced in Example 14 for the central part of the transverse section taken from substantially intermediate portion of the material. The alloy material was of rectangular shape with a size of 30 mm (length)×40 mm (width)×20 mm (thickness). The X-ray diffraction pattern of the material only had a broad halo peak, indicating the single phase constitution of the amorphous phase. The optical micrograph of the central part of the transverse cross section also showed no contrast indicative of the precipitation of the crystal phase to confirm the results of the X-ray diffractometry. These results indicate that the alloy material was formed from the molten metal which was completely free from the molten metal of the region in contact with or in the vicinity of the copper hearth (copper crucible bed) at a temperature below the melting point which invites co-presence of the amorphous and crystal phases, and that nonuniform nucleation due to the contact of the molten metal in the copper hearth with the copper crucible bed is prevented by the present method.

FIG. 9 represents a DSC curve of the $Zr_{55}Al_{10}Cu_{30}Nil_{15}$ alloy material produced in Example 14 for the central amorphous part of the section taken from substantially intermediate portion of the material. The initiation of endothermic reaction by glass transition and the initiation of the exothermic reaction by crystallization are found at 680° C. and 760° C., respectively, and the supercooled liquid state is found over a considerably wide temperature range of 80° C. The results as described above demonstrate the capability of the forging process to produce a really glassy metal, and in addition, capability of the forging process to produce a rectangular alloy material excellent in strength properties solely comprising the amorphous phase by suppressing the occurrence of the nonuniform nucleation. The Vickers hardness (Hv) of the amorphous alloy face material of rectangular shape produced in Example 14 was measured to be 540, which is a value equivalent with the value (550) measured for the corresponding sampling in the form of a ribbon.

FIG. 10 is a photomicrograph (×500) showing the metal texture of the $Zr_{55}Al_{10}Cu_{30}Ni_{15}$ alloy material produced in Example 14 for the central amorphous part of the transverse section taken from substantially intermediate portion of the material. This photomicrograph demonstrates that the amorphous alloy face material of rectangular shape produced is an amorphous single phase alloy face material substantially free from crystalline phase which has been produced by avoiding the nonuniform nucleation.

As demonstrated in Table 1, all of the samples of Examples 1 to 14 exhibited excellent mechanical strength, and the amorphous alloy face material of rectangular shape produced by the cast forging process of the present invention is a face molding material of the head in the golf club which is free from casting defects such as cold shuts and which has excellent strength properties including strength and toughness as well as excellent shot properties. The analysis of the sample obtained in Example 14 reveals that the amorphous alloy face materials of rectangular shape produced in the Examples are amorphous single phase alloy face materials substantially free from crystalline phase which have been produced by avoiding the nonuniform nucleation.

Example II-a to II-e

Of the alloy materials produced in Examples I-1 to I-14, the $Zr_{55}Al_{10}Cu_{30}Ni_{15}$ alloy material produced in Example 14 was used in view of the high tendency of amorphous phase formation, low Young's modulus, and high strength. Samples of the face member adapted for use with a wood-type club head were prepared, and the face was mounted on the club head 3. The experiments were conducted by using the thus prepared golf clubs.

Figure 11:
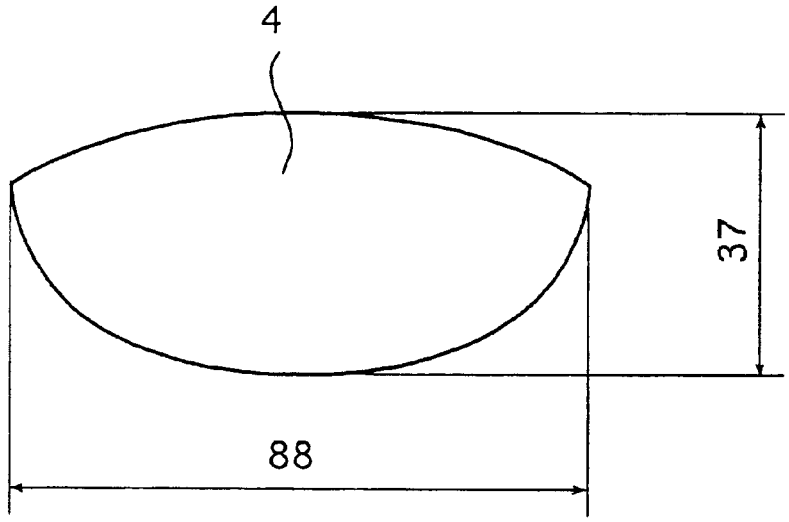
FIG. 11 is a schematic view of the clubface molded in Example II of the present invention.

The faces 4 formed were of the shape shown in FIG. 11. The faces were formed by repeating the procedure of Example I-14 using the lower molds 52 each having a cavity 52*a* with a depth of 1 mm, 2 mm, 3 mm, 4mm, or 5 mm. Samples of the face 4 with 5 different thickness values were prepared, and a plurality of samples were prepared for each type.

Figure 12:
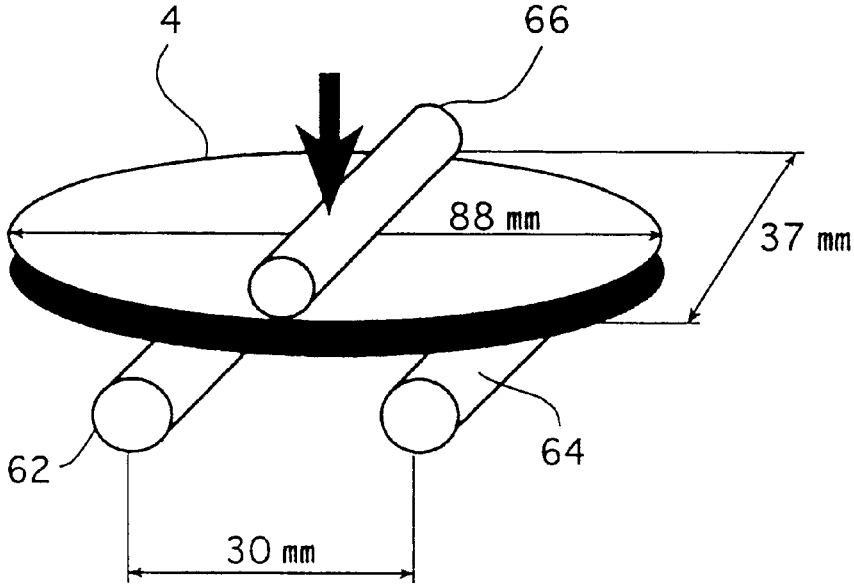
FIG. 12 is a schematic perspective view showing the flexural strength test of the clubface molded in Example II of the present invention.

First, the thus prepared samples of the face 4 were evaluated for their strength by directly applying a flexural load on the face 4 as shown in FIG. 12. In the flexural test of the face shown in FIG. 12, the face 4 was supported between two cylindrical bars 62 and 64 each having a diameter of 10 mm located at a distance of 30 mm, and the load was applied to the face 4 by a bar having a diameter of 10 mm placed on the face 4 at the center between the two supporting bars 62 and 64. The strength was evaluated by increasing the load and measuring the load at break. The results are shown in Table 2.

In the meanwhile, golf clubs were prepared by using the thus prepared samples of the face 4. The face 4 was joined to the head 3 (a club head of wood type fabricated from a titanium alloy with a volume of 270 cc) by machining a fitting on each of the face 4 and the head 3 and adhering these members with an epoxy adhesive.

The thus prepared club head 3 was mounted on a shaft (Farject WT50V510 Brown Carbon manufactured by Sumitomo Rubber Industries, Ltd.) to complete the golf club and to evaluate the performance of the club in terms of coefficient of restitution (defined as the ratio of initial speed of the ball/head speed) and durability of the face member.

First, the performance of the club in terms of the coefficient of restitution was evaluated as described below. The golf club prepared was mounted on a swing robot, and the golf balls (DDH TOUR SPECIAL manufactured by Sumitomo Rubber Industries, Ltd.) were shot at a head speed of 45 m/s. The value calculated by dividing the initial speed of the ball by the head speed immediately before the impact was defined as the coefficient of restitution, and the restitution of the club head was evaluated by the value of the coefficient of restitution. The results are shown in Table 2.

Next, the durability of the face member was evaluated by using the same swing robot and actually hitting the golf ball at a head speed of 50 m/s, and damages caused were visually determined. The number of shots was 5000 at maximum, and the test was stopped when damages were observed. The durability was evaluated by the criteria as described below:

No damage before 5000 shots: ○

Damaged at 1000 to 5000 shots: Δ

Damaged at less than 1000 shots: ×

The results are shown in Table 2.

TABLE 2

| Experiments | Face thickness, mm | Flexural strength, kgf | Coefficient of restitution | Durability | Young's modulus, GPa | E × T |
|---|---|---|---|---|---|---|
| Exp. a | 1.0 | 500 | 1.455 | X | 85 | 85 |
| Exp. b | 2.0 | 1000 | 1.442 | ○ | 85 | 170 |
| Exp. c | 3.0 | 1800 | 1.436 | ○ | 85 | 255 |
| Exp. d | 4.0 | 2900 | 1.430 | ○ | 85 | 340 |
| Exp. e | 5.0 | ≧3000 | 1.421 | ○ | 85 | 425 |

* Young's modulus: The results of Example 14 were used.

As shown in Table 2, when the experiments were conducted by preparing the face members of 1 to 5 mm thick, the restitution between the head and the ball increased with the decrease in the thickness of the face, namely, with the decrease in the value of E×T. The coefficient of restitution was highest when the face had a thickness of 1.0 mm. However, the sample with such thickness, that is, with an excessively small value of E×T became damaged before 1000 shots. The results demonstrate that the face having a value of E×T in the range of 100 to 350 GPa·mm is desirable as a face for use in a club head in view of the coefficient of restitution and the durability.

As demonstrated in the foregoing, the thus produced golf club with a club head having a metallic glass face utilizes a clubface of highly reliable quality with little variation in the properties which has excellent strength properties including strength and toughness. The impact between the golf ball and the clubface in the shot is highly reproducible and reliable, and the golf club exhibits good shot properties and strength properties including the shot distance and direction, impact properties, strength, toughness, and the like. The golf club can be reliably produced at a high yield and at a reduced production cost.

What is claimed is:

1. A method of fabricating a golf club with a club head having a metallic glass face of desired shape free from cold shuts comprising the steps of:

filling a metal material in a hearth;

melting said metal material by using a high-energy heat source which is capable of melting said metal material;

pressing the molten metal at a temperature above a melting point of said metal material to deform the molten metal into the desired shape by at least one of compressive stress and shear stress at a temperature above the melting point, while avoiding surfaces of the molten metal cooled to a temperature below the melting point of said metal material from meeting with each other during the pressing;

cooling said molten metal at a cooling rate higher than a critical cooling rate of the metal material simultaneously with or after said deformation to produce the metallic glass face;

embedding said metallic glass face in said club head; and connecting said club head to a club shaft; and wherein said metallic glass face has a Vickers hardness of at least 300 Hv, a thickness in the range of 1.5 mm to 4.5 mm, and a value of the product E×T of Young's modulus E (GPa) and thickness T (mm) in the range of 100 to 350.

2. The method according to claim 1, wherein said metallic glass face has a Vickers hardness of at least 300 Hv.

3. The method according to claim 1, wherein said metallic glass face has a Young's modulus in the range of 50 GPa to 150 GPa.

4. The method according to claim 1, wherein said metallic glass face has a thickness in the range of 1.5 mm to 4.5 mm.

5. The method according to claim 1, wherein said metallic glass face has a value of the product E×T of Young's modulus E (GPa) and thickness T (mm) in the range of 100 to 350.

6. The method according to claim 1, wherein said metallic glass face has a tensile strength of at least 1000 MPa.

7. The method according to claim 1, wherein said molten metal at a temperature above the melting point of said metal material is pressed while avoiding not only the meeting of the surfaces of the molten metal cooled to a temperature below the melting point of said metal material with each other but also meeting of such molten metal surface with another surface cooled to a temperature below the melting point of said metal material.

8. The method according to claim 1, wherein the pressing and deforming of said molten metal is accomplished by selectively rolling said molten metal at a temperature above the melting point of said metal material into plate shape or other desired shape with a cooled roll for rolling mounted on said hearth, while cooling simultaneously.

9. The method according to claim 8, wherein said metallic glass face is a metallic glass face of plate shape or other desired shape produced by, after melting said metal material filled in the hearth, selectively rolling the molten metal at a temperature above the melting point rising over the hearth with simultaneous cooling by rotating said cooled roll and moving the hearth in relation to said high energy heat source and said cooled roll for rolling.

10. The method according claim 8, wherein said hearth is of elongated shape, and wherein said metallic glass face comprises a plurality of metallic glass faces of plate shape or other desired shape produced by continuously conducing the melting, the rolling of the molten metal at a temperature above the melting point, and the cooling by using said hearth of the elongated shape and moving said hearth in relation to said high energy heat source and said cooled roll for rolling to thereby serially produce metallic glass faces.

11. The method according to claim 8, wherein said cooled roll for rolling is provided at the position corresponding to the hearth with a molten metal-discharging mechanism for discharging the molten metal at a temperature higher than the melting point from the hearth, said molten metal-discharging mechanism being fabricated from a material having low thermal conductivity.

12. The method according to claim 1, wherein the pressing and deforming of said molten metal is accomplished by selectively transferring said molten metal at a temperature above the melting point of said metal material into a cavity of the desired shape in the mold provided near said hearth without fluidizing the molten metal, and pressing the molten metal with a cooled upper mold without delay to forge the molten metal into the desired shape together with simultaneous cooling.

13. The method according to claim 12, wherein said metallic glass face is a metallic glass face of the desired shape produced by, after melting said metal material filled in the hearth, moving said hearth and said lower mold to right underneath said upper mold and descending the upper mold toward the lower mold without delay to thereby selectively transfer the molten metal at a temperature above the melting point into said lower mold where the molten metal is pressed and cooled for forging.

14. The method according to claim 12, wherein said upper mold is provided at the position corresponding to the hearth with a molten metal-discharging mechanism for discharging the molten metal at a temperature higher than the melting point from the hearth, said molten metal-discharging mechanism being fabricated from a material having low thermal conductivity.

15. A method of fabricating a golf club comprising a club head having a metallic glass face of desired shape free from cold shuts;

said metallic glass face having a Vickers hardness of at least 300 Hv, a Young's modulus in the range of 50 GPa to 150 GPa, a thickness in the range of 1.5 to 4.5 mm, a tensile strength of at least 1000 MPa, and a value of the product E×T of Young's modulus E (GPa) and thickness T (mm) in the range of 100 to 350; said method comprising the steps of:

filling a metal material in a hearth;

melting said metal material by using a high-energy heat source which is capable of melting said metal material;

pressing molten metal at a temperature above a melting point of said metal material to deform the molten metal into the desired shape by at least one of compressive stress and shear stress at a temperature above the melting point, while avoiding surfaces of the molten metal cooled to a temperature below the melting point of said metal material from meeting with each other during the pressing;

cooling said molten metal at a cooling rate higher than a critical cooling rate of the metal material simultaneously with or after said deformation to produce the metallic glass face;

embedding said metallic glass face in said club head; and connecting said club head to a club shaft.

* * * * *